US007142160B2

(12) United States Patent
Furuno et al.

(10) Patent No.: US 7,142,160 B2
(45) Date of Patent: Nov. 28, 2006

(54) SMALL SIZE ANTENNA, SURFACE MOUNTING TYPE ANTENNA AND ANTENNA DEVICE AS WELL AS RADIO COMMUNICATION DEVICE

(75) Inventors: Tsuyoshi Furuno, Gamo-gun (JP); Kazuo Watada, Soraku-gun (JP); Koji Hamada, Soraku-gun (JP); Shunichi Murakawa, Kyoto (JP)

(73) Assignee: Kyocera Corporation, Kyoto (JP)

( * ) Notice: Subject to any disclaimer, the term of this patent is extended or adjusted under 35 U.S.C. 154(b) by 33 days.

(21) Appl. No.: 10/939,169

(22) Filed: Sep. 10, 2004

(65) Prior Publication Data

US 2005/0062650 A1 Mar. 24, 2005

(30) Foreign Application Priority Data

Sep. 11, 2003 (JP) ..... P 2003-320239

(51) Int. Cl.
*H01Q 1/38* (2006.01)
*H01Q 1/24* (2006.01)

(52) U.S. Cl. ..... 343/700 MS; 343/702

(58) Field of Classification Search ..... 343/700 MS, 343/702

See application file for complete search history.

(56) References Cited

U.S. PATENT DOCUMENTS

| | | | | |
|---|---|---|---|---|
| 6,177,908 | B1 | 1/2001 | Kawahata et al. | |
| 6,683,573 | B1 * | 1/2004 | Park | 343/700 MS |
| 6,683,576 | B1 * | 1/2004 | Achim | 343/702 |
| 6,795,026 | B1 * | 9/2004 | Chiu et al. | 343/702 |
| 6,806,832 | B1 * | 10/2004 | Sato et al. | 343/700 MS |
| 2002/0167448 | A1 * | 11/2002 | Kushihi et al. | 343/700 MS |
| 2003/0048225 | A1 * | 3/2003 | Yoon | 343/700 MS |
| 2003/0193439 | A1 | 10/2003 | Park | |
| 2004/0183733 | A1 * | 9/2004 | Aoyama et al. | 343/702 |

FOREIGN PATENT DOCUMENTS

| | | | |
|---|---|---|---|
| EP | 0 766 340 | | 4/1997 |
| EP | 0766340 | * | 4/1997 |
| EP | 1 162 688 | | 12/2001 |
| EP | 1 239 533 | | 9/2002 |
| JP | 08-055726 | | 2/1996 |

(Continued)

OTHER PUBLICATIONS

Junker, et al., "Effect of Air Gap On Cylindrical Dielectric Resonator Antenna Operating in $TM_{01}$ Mode", Electronics Letters, Jan. 1994, vol. 30, No. 2, pp. 97 to 98.

(Continued)

*Primary Examiner*—Don Wong
*Assistant Examiner*—Hung Tran Vy
(74) *Attorney, Agent, or Firm*—Hogan & Hartson LLP

(57) ABSTRACT

In order to provide a small size antenna where excellent antenna properties can be stably gained, a frequency adjustment is easy and a simple measurement is possible, according to the present invention, a small size antenna formed of a conductor of at least two adjoining surfaces of a base in rectangular parallelepiped form made of dielectric ceramics is characterized in that: a step is made of a flat portion parallel to one surface of the two adjoining surfaces and an inclining portion located between the one surface and the flat portion, in a corner portion of the two surfaces on which the conductor is formed; the width of the flat portion is 0.08 mm or less; and a border portion between the flat portion and the other surface of the two adjoining surfaces is a curve having a curvature radius R of 0.03 mm to 0.2 mm.

16 Claims, 14 Drawing Sheets

FOREIGN PATENT DOCUMENTS

| | | |
|---|---|---|
| JP | 10-41722 | 2/1998 |
| JP | 2002-158529 | 5/2002 |
| JP | 2002-204120 | 7/2002 |
| JP | 2002-314330 | 10/2002 |
| JP | 2003-289214 | 10/2003 |

OTHER PUBLICATIONS

Cormos, et al., "Compact Dielectric Resonator Antenna for WLAN Applications", Electronics Letters, Apr. 3, 2003, Vo. 39, No. 7.

* cited by examiner

SMALL SIZE ANTENNA, SURFACE MOUNTING TYPE ANTENNA AND ANTENNA DEVICE AS WELL AS RADIO COMMUNICATION DEVICE

BACKGROUND OF THE INVENTION

1. Field of the Invention

The present invention relates to a surface mounting type small size antenna that is used in the communication field, particularly used by being incorporated in mobile communication equipment such as cellular phones and, in particular, relates to a small size surface mounting antenna and an antenna device which deal with double channels as well as a radio communication device using the same.

2. Description of the Related Art

In recent years, miniaturization of mobile communication equipment such as cellular phones has made rapid progress. Together with the miniaturization of such communication equipment, antennas which are incorporated in communication equipment are also required to be miniaturized and a small size antenna where a conductor is formed on the surface of a base in rectangular parallelepiped form so that the antenna is mounted on the surface of an internal board of communication equipment has been put into practical use.

FIG. 4 is a perspective view schematically showing a small size antenna according to the prior art and FIG. 5 is a cross sectional view in the longitudinal direction of FIG. 4. As shown in FIG. 4, in a small size antenna 15 which is mounted on surfaces of a board 4 within communication equipment by means of solders 3 according to the prior art, conductors 2 are formed on the surface of a base 13 in rectangular parallelepiped form and are electrically connected to wires (not shown) on the board 4. In general, the conductors 2 are formed over two or more surfaces of the base 13 and, for example, the conductors 2 are sequentially formed over four surfaces that include surfaces 8 and 11 as shown in FIG. 5. The conductors 2 are formed by screen printing a conductor paste on each surface in a sequential manner.

As for the method for electrically connecting the conductors 2 on the adjoining two surfaces to each other as described above, in general, a screen having a pattern greater than the pattern of a conductor 2 is utilized, thereby, generating a sag on the next surface so that such a sag is utilized for an electrical connection. FIG. 6 is an enlarged cross sectional view showing a small size antenna according to the prior art where a screen printing has been carried out by using a screen having a pattern greater than the pattern of the conductor 2 on the surface 8. As shown in FIG. 6, the conductor 2 printed on the surface 8 causes the sag 18 on the surface 11. This sag 18 makes contact with the conductor 2 on the surface 11 to form an electric connection when the conductor 2 is screen printed on the surface 11.

In the case where such a small size antenna is mounted on the surface of a board in a cellular phone or the like, this small size antenna is secured to the board 4 by means of the solders 3 as shown in FIG. 4. It becomes necessary to scrap the board 4 together with the antenna, though this is economically disadvantageous, in the case where the properties of the antenna are found to be defective as a result of quality management where the frequency properties are measured after the antenna has been secured to the board 4 by means of the solders 3. Here, in general, the frequency is measured by using a network analyzer in order to inspect the antenna to see if it functions properly.

Therefore, the small size antenna 15 is installed on the board 4 without being secured by means of the solders 3 so that the frequency is measured in this condition or the small size antenna 15 is secured onto the board 4 by applying pressure to the small size antenna 15 from above or by sucking the antenna from beneath so that the frequency is measured.

However, in a small size antenna according to the prior, as shown in FIG. 6, the conductor 2 is printed by using a screen having a pattern greater than that of the conductor 2 and, thereby, a protrusion 23 is also formed simultaneously as the sag 18 is formed. This is considered to occur because some conductor paste stays in the portions of the screen as a result of the usage of the screen having a pattern greater than that of the conductor 2.

Here, in the case where the frequency of the small size antenna 15 on which the protrusion 23 has been formed is attempted to be measured, no problem with the measurement arises when the antenna is secured onto the board 4 by using the solder 3 as shown in FIG. 8A because the solder 3 fills in the space between the conductor 2 and the board 4 in spite of the existence of the protrusion 23. However, in the case where measurement is carried out without utilizing the solder 3, as shown in FIG. 8B, a gap occurs between the board 4 and the conductor 2 due to the protrusion 23 and a problem arises where the frequency becomes different from that of the case where measurement is carried out when the antenna is secured to the board by using the solder 3.

It is considered that this is because air, which is a dielectric body, exists in the space between the board 4 and the conductor 2, which occurs due to the protrusion 23, and, thereby, a difference is made in the electrical properties leading to a difference in the frequency.

In addition, in the case where the base 13 in rectangular parallelepiped is utilized, a problem arises where chipping occurs when bases 13 collide into each other during the manufacturing process for bases 13 in rectangular parallelepiped form or during the process for forming conductors 2 or base 13 collides into a jig or the like that is utilized during the manufacturing process. In the case where chipping has occurred, the product might become defective judging from the appearance and at the same time, in the case where chipping has occurred to a portion of the conductor 2, the product loses the function as an antenna due to the occurrence of disconnection.

In order to avoid this problem, there is a method for preventing chipping of ceramic where a C surface or a step is provided on an outer periphery portion. FIG. 7 is an enlarged cross sectional view schematically showing a small size antenna according to the prior art in the case where a step 21 has been created in a corner portion of the base 13 when the antenna is formed using dies for powder press formation.

As shown in FIG. 7, a step 21 made of an inclining portion 19 and a flat portion 20 is provided in a corner portion of base 13 and, thereby, the occurrence of chipping of the base 13 is prevented. In the case of a small size antenna, however, an electrical connection between the conductors 2 on the surface 8 and on the surface 11 is necessary while it becomes necessary for length g of the flat portion 20 to be 0.08 mm or greater taking the strength of dies for an extended period of time into consideration in the case where the step 21 is created in the corner portion of the base 13 by means of the dies. A problem arises where some products lack the properties required for an antenna as a result of the occurrence of an electrically insufficient connection when the connection is made using a sag of the conductor 2 in the above described space of 0.08 mm or longer.

In addition, in recent years a surface mounting type antenna that deals with double channels and an antenna device using the same has been introduced to the market and dynamic development thereof has progressed. In the following, an antenna that deals with two frequencies according to the prior art is described in reference to the perspective view of FIG. 13.

In FIG. 13, a surface mounting type antenna, which is denoted as 81, is mounted on a mounting substrate 92 so as to form an antenna device. In the surface mounting type antenna 81, shown in FIG. 13, a base in rectangular parallelepiped form is denoted as 86, a feeding terminal is denoted as 85 and radiation electrodes are denoted as 82 and 83. In addition, in the mounting substrate 92, a feeding electrode is denoted as 94 and a grounding conductive layer is denoted as 93.

In the surface mounting type antenna 81 of this FIG. 13, two frequencies can be dealt with by changing the pitches of the radiation electrodes 82 and 83. That is to say, the pitch of the radiation electrode 83 in spiral form that is connected to the feeding terminal 85 on a side of the base 86 is expanded while the pitch of radiation electrode 82 in spiral form that is connected to the radiation electrode 83 is condensed and, thereby, the antenna is formed so as to be able to deal with two different frequencies.

Thus, the surface mounting type antenna 81 that has been formed as described above is mounted on the surface of the mounting substrate 92 and the feeding terminal 85 is connected to the feeding electrode 94, thereby forming the antenna device 91 that deals with two frequencies.

In addition, an antenna for a mobile communication terminal is disclosed as another type of antenna that deals with two frequencies in a manner wherein a ground capacitance of an antenna element is connected to an antenna element for a predetermined frequency band so as to change this value and, thereby, the antenna can be utilized in a plurality of frequency bands that includes another frequency band different from the predetermined frequency band (see for example, Japanese Unexamined Patent Publication No. 2002-204120). This antenna makes it unnecessary to insert a switch in series in a transmission path of signals that are transmitted and are received and, therefore, it can be said that it is possible to form an antenna which can cope with a plurality of frequencies without causing a problem of signal transmission loss.

In addition, an antenna device is also disclosed wherein a dielectric base, a plurality of power supply radiation elements each of which has a feeding electrode and a radiation electrode formed on the surface of this base, and a substrate for securing the base are provided where one power supply point for supplying power to all of the power supply radiation elements is provided on this substrate, and at the same time, stubs are provided on the surface of the substrate or on the surfaces of the base and the substrate so as to be sequentially deployed starting from the power supply point so that the feeding electrode of a power supply radiation element is connected to the matching point of a stub that is determined based on the effective line length of the radiation electrode (see for example, Japanese Unexamined Patent Publication No. 2002-314330). This antenna device allows each power supply radiation element to be excited by the resonant frequency that is determined by the effective line length of a radiation electrode and at this time, the feeding electrode of each power supply radiation element is connected to the matching point of the stub having the optimal stub length for each power supply radiation element and, therefore, each power supply radiation element can gain a resonance properties which are appropriate in each of the resonant frequencies. It can be said that such an antenna device allows a necessary band width of the frequency band to which each of the resonant frequencies belongs to be secured.

In the surface mounting type antenna 81 according to the prior art as shown in FIG. 13, however, it is necessary to adjust the lengths and the pitches (intervals) of the radiation electrodes 82 and 83 in spiral form in order to tune the operation frequency of the surface mounting type antenna 81 to each of low frequency f1 and high frequency f2 of the radio signals utilized in the communication system and a problem arises where a large amount of time and effort is required for such adjustments.

In addition, when the surface mounting type antenna 81 is attempted to be miniaturized by increasing the dielectric constant of the base 86, an unnecessary resonance mode unexpectedly occurs between the long radiation electrodes 82, 83 in spiral forms and the grounding conductor 93 preventing stable antenna properties that deal with two frequencies from being gained and, thus, a problem arises where the miniaturization of the antenna is difficult.

In addition, there is a problem in the antenna for a mobile communication terminal that is disclosed in Japanese Unexamined Patent Publication No. 2002-204120 where it is difficult to mount the antenna on the surface of a mounting substrate.

Furthermore, there is a problem in the antenna device disclosed in Japanese Unexamined Patent Publication No. 2002-314330 where it is difficult to miniaturize the antenna because the radiation electrodes have two-dimensional patterns increasing the size of the antenna

SUMMARY OF THE INVENTION

The present invention is provided in order to solve the problems with the above described prior art, and an object of the present invention is to provide a small size antenna where excellent antenna properties can be stably gained, a frequency adjustment is easy and a simple measurement is possible.

In addition, an object of the present invention is to provide a surface mounting type antenna which can be miniaturized and which deals with two frequencies, and to provide an antenna device that uses such an antenna.

Furthermore, another object of the present invention is to provide a radio device that deals with two frequencies by having the above described surface mounting type antenna that deals with two frequencies, or the above described antenna device.

In order to achieve the above described objects, the small size antenna of the present invention is a small size antenna having a base in rectangular parallelepiped form made of dielectric ceramics and a conductor formed on at least two adjoining surfaces of said base continuously. The small antenna is characterized in that: a corner portion of said two adjoining surfaces on which said conductor is formed has a step having a flat portion parallel to one surface of said two adjoining surfaces and an inclining portion located between said one surface and said flat portion, the width of said flat portion is 0.08 mm or less; and a border portion between said flat portion and the other surface of said two adjoining surfaces is a curved surface having a curvature radius R of 0.03 mm to 0.2 mm.

The small size antenna according to the present invention that is formed as described above can prevent the occurrence of a protrusion of the conductor, making the evaluation of the properties possible without soldering, and has the width of the flat portion that is limited to 0.08 mm or less, where the border portion with a curve of which the curvature radius R is 0.03 mm to 0.2 mm, and therefore, it becomes possible to connect conductors formed on the adjacent surfaces to each other without failure, and the ratio of defects due to chipping, the ratio of defects due to disconnection and variation in the frequency can be reduced.

In addition, it is preferable for the depth of the above described step in the small size antenna of the present invention to be 0.15 mm or less, and such a configuration allows the conductors to be connected to each other in the corner portion without failure, thereby reducing the ratio of defects due to chipping, the ratio of defects due to disconnection and variation in the frequency.

Furthermore, it is preferable for the angle of the above described inclining portion to be 100° to 160°, and when the angle of the above described inclining portion is in this range, the conductor formed on the plane that continues to the inclining portion can be formed so as to be highly adhered to the end portion of the inclining portion, thereby reducing the ratio of defects due to chipping, the ratio of defects due to disconnection and variation in the frequency.

Moreover, it is preferable for the difference between the thickness of the conductor formed on the above described step and the thickness of the conductor formed on the plain to be 0.02 mm or less, and it is preferable for the missing portion of the conductor formed on the above described step to be 50% or less relative to the width of the conductor.

When, as described above, the difference between the thickness of the conductor formed on the above described step and the thickness of the conductor formed on the plain is 0.02 mm or less, and the missing portion of the conductor formed on the above described step is 50% or less relative to the width of the conductor, a frequency measurement with a high precision can be carried out without the occurrence of variation between the frequency measured by securing the small size antenna to the board and the frequency measured by placing the antenna on the board without being soldered.

In addition, the surface mounting type antenna according to the present invention is characterized by being provided with: a base in rectangular parallelepiped form made of dielectrics or a magnetizer; a first radiation electrode formed on one side of two sides that face each other; a second radiation electrode formed on the other side of the above described two sides; a third radiation electrode formed on a side other than the above described two sides for connecting the above described first radiation electrode to the above described second radiation electrode; and a fourth radiation electrode formed on the above described side other than the above described two sides or on the side that faces the above described side other than the above described two sides, one end of which is connected to the above described second radiation electrode, and the other end of which is used as a feeding terminal.

Here, the third radiation electrode may be an electrode in line form formed close to either of the two end surfaces that face each other, and the fourth radiation electrode may also be an electrode in line form formed close to either of the two end surfaces that face each other.

Radiation electrodes having short multiple resonance patterns are formed on a pair of sides of a base that face each other in the surface mounting type antenna of the present invention that is formed as described above, and therefore, wavelength shortening effects due to the dielectric constant or relative permeability can be gained while avoiding unnecessary resonance caused by the dielectric constant or relative permeability, and thus a small size antenna that deals with two frequencies can be implemented.

That is to say, the surface mounting type antenna of the present invention generates multiple resonances when power is supplied from the power feeding point to the first to third radiation electrodes formed of the portions that face each other and the portion that connects these portions that face each other via the fourth radiation electrode. As a result of this, the antenna can be operated as an antenna of ¼ wavelength that corresponds to frequency f2 on the second radiation electrode side, and can be operated as an antenna of ¼ wavelength that corresponds to frequency f1 (in general f1<f2) that is different from f2 on the first electrode side which is connected to the second electrode side through the third electrode, and thus the antenna can be appropriately operated as a surface mounting type antenna that deals with two frequencies.

In addition, it is preferable in the surface mounting type antenna according to the present invention that a step is formed of an inclining portion and a flat portion parallel to either side in a corner portion in which at least one of the above described third radiation electrode and the above described fourth radiation electrode is formed in a manner where the width of the above described flat portion is 0.08 mm, and the border portion between the above described flat portion and the side that continues to this flat portion is a curve having a curvature radius R of 0.03 mm to 0.2 mm.

In such a configuration, the occurrence of a protrusion of the conductor can be prevented even in the case where the miniaturization of the antenna is achieved, and therefore, the evaluation of the properties becomes possible without soldering.

In addition, the width of the flat portion is limited to 0.08 mm or less, and the border portion is made of a curve having a curvature radius R of 0.03 mm to 0.2 mm, and therefore, it becomes possible to connect the conductors formed on the adjoining surfaces to each other without failure, and thus the ratio of defects due to chipping, the ration of defects due to disconnection and a variation in the frequency can be reduced.

In addition, a recess may be provided in the above described side different from the two sides that face each other or in the above described side that faces the above described side different from the two sides that face each other, or a through hole that runs from the above described side different from the two sides that face each other to the above described side that faces the above described side different from the two sides that face each other, may be provided in the above described base of the surface mounting type antenna according to the present invention. In such a configuration, the weight of the base can be reduced without sacrificing antenna properties, and thus, the reduction of the weight of the surface mounting type antenna can be achieved. In addition, such a reduction of weight allows the reliability of the mounting strength against an impulse after the mounting to be increased.

In addition, the antenna device of the present invention is formed by mounting a surface mounting type antenna according to the present invention on a mounting substrate that has a feeding electrode and a grounding conductive layer that is separate from this feeding electrode on the mounting surface, where the above described surface mounting type antenna is mounted on the above described mounting surface, and the above described feeding terminal is connected to the above described feeding electrode so that the distance between the above described second radiation electrode and the above described grounding conductive layer is greater than the distance between the above described first radiation electrode and the above described grounding conductive layer.

In the antenna device according to the present invention that is formed as described above, the second radiation electrode side of the surface mounting type antenna forms an antenna for high frequency f2, and the first radiation electrode side that is connected to the second radiation electrode side through the third radiation electrode forms an antenna for low frequency f1. In addition, in the surface mounting type antenna of the present invention of the antenna device according to the present invention, the second radiation electrode side that corresponds to high frequency f2 is installed in a position away from the grounding conductive layer in comparison with the first radiation electrode side that corresponds to low frequency f1. Additionally, the radiation electrodes on the side that corresponds to high frequency f2 become the second radiation electrode and the fourth radiation electrode, which are formed over multiple surfaces. As a result of this, a radio wave having a polarized wave perpendicular to the second radiation electrode, which is difficult to be transmitted and received exclusively by the second radiation electrode, is transmitted and received by the fourth radiation electrode, and thereby, it becomes possible to transmit and receive a radio wave in every orientation. As a result of this, radiation properties on the high frequency side, which, in general, become poor, can be made to be the same quality as radiation properties on the low frequency side.

Furthermore, in the antenna device according to the present invention, the above described surface mounting type antenna may be mounted on the above described mounting surface so that the above described two sides that face each other become parallel to the above described mounting surface, or the above described surface mounting type antenna may be mounted on the above described mounting surface so that the above described two sides that face each other become perpendicular to the above described mounting surface.

In addition, the wireless communication device according to the present invention is characterized by being provided with a surface mounting type antenna according to the present invention, and a transmission circuit and/or reception circuit connected to the feeding terminal of the antenna.

In addition, in the case where the antenna device according to the present invention is a wireless communication device further provided with a mounting substrate having a feeding electrode and a grounding conductive layer that is separate from this feeding electrode on the mounting surface, it is preferable for the above described surface mounting type antenna to be mounted on the above described mounting surface, and for the above described feeding terminal to be connected to the above described feeding electrode so that the distance between the above described second radiation electrode and the above described grounding conductive layer becomes greater than the distance between the above described first radiation electrode and the above described grounding conductive layer.

The wireless communication device according to the present invention that is formed as described above is provided as a small size and highly functional wireless communication device that can deal with two frequencies by using one surface mounting type antenna or antenna device.

As described above, according to the present invention, a surface mounting type antenna that can deal with two frequencies where excellent antenna properties can be stably gained, a frequency adjustment is easy and miniaturization of the antenna is possible, as well as an antenna device that uses such an antenna, can be provided, and a wireless communication device that can deal with two frequencies having the above described surface mounting type antenna or antenna device that can deal with two frequencies can be provided.

DESCRIPTION OF THE PREFERRED EMBODIMENTS

In the following, the preferred embodiments according to the present invention are described in detail.

Embodiment 1

Figure 1:
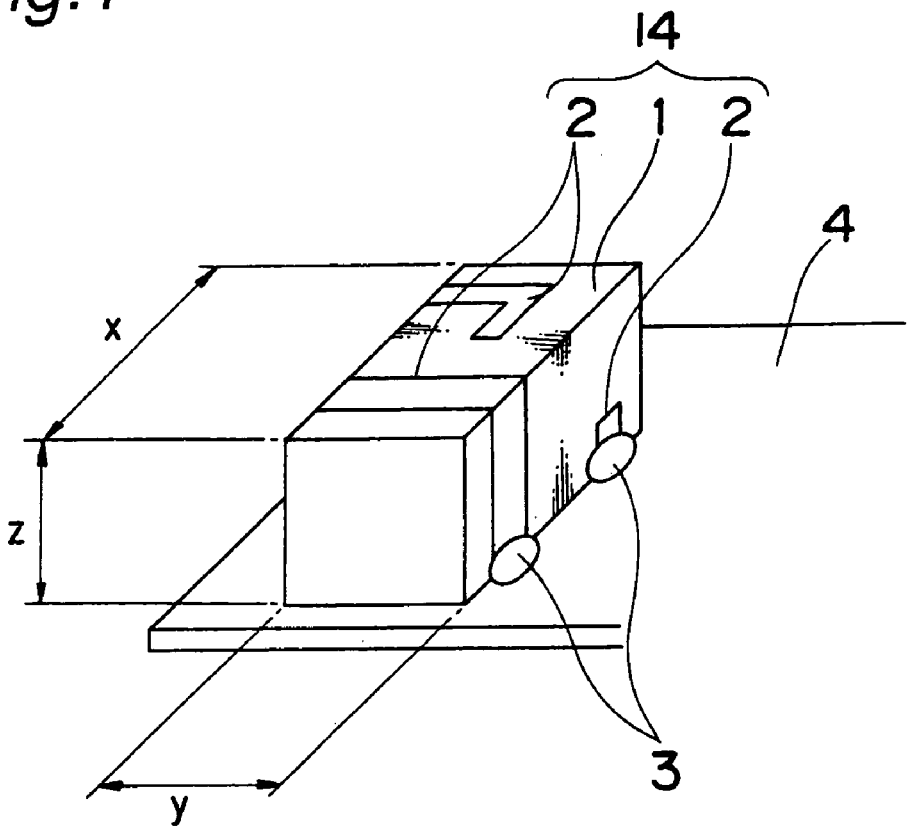
FIG. 1 is a perspective view showing the configuration of a small type antenna according to Embodiment 1 of the present invention.
Figure 2A:
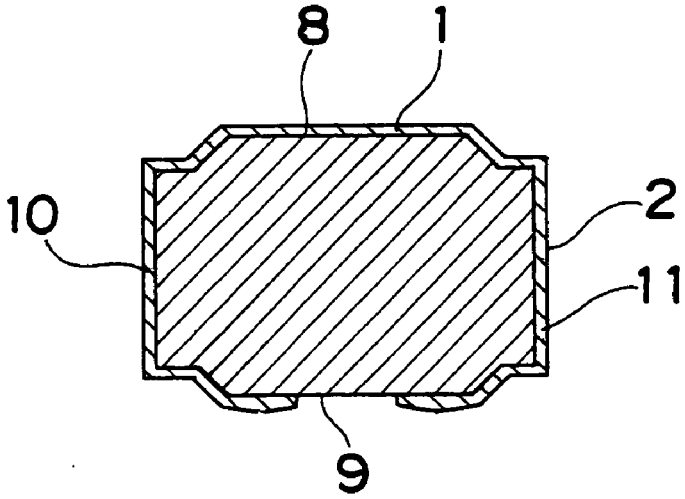
FIG. 2A is a cross-sectional view in the longitudinal direction of FIG. 1.
Figure 2B:
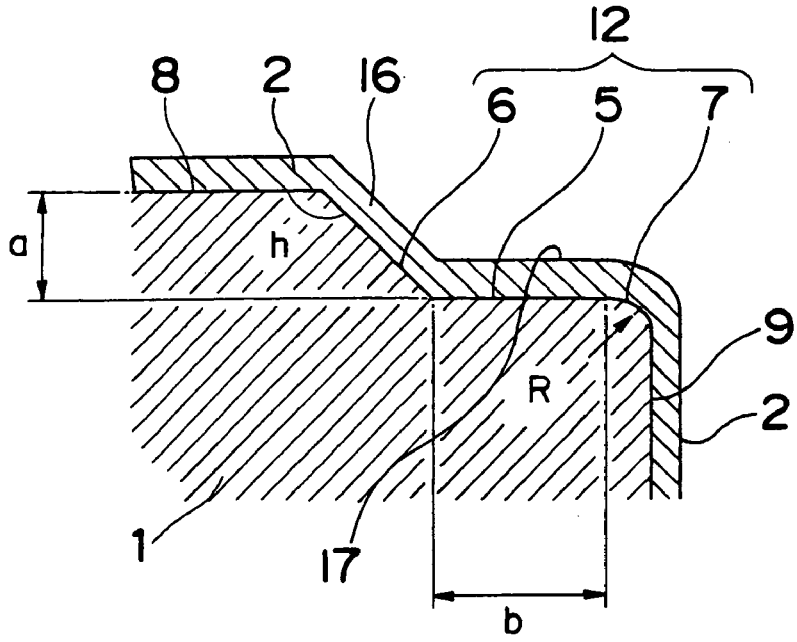
FIG. 2B is an enlarged cross-sectional view showing a portion of FIG. 2A.

FIG. 1 is a perspective view schematically showing the configuration of a small size antenna according to Embodiment 1 of the present invention, FIG. 2A is a cross-sectional view in the longitudinal direction showing the same, and FIG. 2B is an enlarged cross-sectional view showing a portion of FIG. 2A.

As shown in FIGS. 1, 2A and 2B, a small size antenna 14 of the present invention is made of dielectric ceramics, where conductors 2 are formed of at least two adjoining sides of base 1 in rectangular parallelepiped form in a sequential manner. Here, one end of each conductor 2 is used as a feeding terminal for applying a voltage, and is connected to a feeding electrode that is formed on a mounting surface of a board 4 by means of a solder 3.

The base 1 is made of Ba—Nd—Ca—Ti based dielectric ceramics (of which the relative dielectric constant is 80 to 120), Nd—Al—Ca—Ti based dielectric ceramics (of which the relative dielectric constant is 43 to 46), La—Al—Sr—Ti based dielectric ceramics (of which the relative dielectric constant is 38 to 41), Ba—Ti based dielectric ceramics (of which the relative dielectric constant is 34 to 36), Ba—Mg—W based dielectric ceramics (of which the relative dielectric constant is 20 to 22), Mg—Ca—Ti based dielectric ceramics (of which the relative dielectric constant is 19 to 21), alumina ceramics (of which the relative dielectric constant is 9 to 10), cordierite ceramics (of which the relative dielectric constant is 4 to 6), or the like, and is gained by forming its compact by means of powder pressing formation or the like using dies, and by firing this compact.

In addition, the conductors 2 formed on the surface of the base 1 are made of a conductive material such as Ag, Ag—Pd or Ag—Pt, and are formed by screen printing the conductive material in paste form onto a predetermined pattern, and after that, by firing at a predetermined temperature. The screen printing is carried out on each surface in a sequential manner, wherein a screen having a pattern greater than that of the conductor 2 of each surface is utilized so as to generate a sag on the next surface so that an electrically connected continuous conductor pattern is formed according to a method for electrically connecting the conductors 2 printed on adjoining surfaces.

Here, as shown in FIGS. 2A and 2B, it is important in the present Embodiment 1 that a step 12 made of an inclining portion 6 and a flat portion 5 having a width of 0.08 mm or less, which is referred to as length b, is formed in the corner portion between the two surfaces 8 and 11 on which the conductor 2 is formed in a continuous manner, and that at least a border portion 7 between flat portion 5 and the surface 11 that continues to this flat portion 5 is a curve having a curvature radius R of 0.03 mm to 0.2 mm.

As described above, the step 12 is formed of the inclining portion 6 and the flat portion 5 in the corner portion between the two surfaces 8 and 11, and thereby, the occurrence of chipping and disconnection of the conductors 2 can be prevented even in the case where bases 1 collide with each other or collide with a jig or the like utilized in the manufacturing process, during the manufacturing process of bases 1 and during the process for forming the conductors 2. In addition, the width b of the flat portion 5 is made to be 0.08 mm or less, and thereby, a sag 17 of the conductor 2 that occurs when the conductor 2 is printed on the surface 11 that continues to the flat portion 5, and a sag 16 of the conductor 2 that is printed on the surface 8 that continues to the inclining portion 6, make sufficient electrical conductance between the conductors so as to prevent electrical disconnection (see FIGS. 2A and 2B).

In addition, the border portion 7 is a curve having a curvature radius R of 0.03 mm to 0.2 mm, and thereby, the screen makes contact with the border portion 7 along the curve thereof, thus forming a constant thickness of the conductor 2 and increasing the size of the sag 17 when the conductor 2 is printed on the surface 11 that continues to the flat portion 5.

Here, in the case where the above described curvature radius R is 0.03 mm or less, the protrusion 23 as described in the prior art may occur, or such a protrusion may be increased, making the measurement of the frequency of the antenna difficult, due to an increased difference in the measured frequency between the case where the frequency is measured by securing the small size antenna 14 to the board 4 by utilizing the solders 3, and the case where small size antenna 14 is secured to the board 4 without utilizing the solders 3. In addition, it becomes economically disadvantageous for the curvature radius R to exceed 0.2 mm, due to the lengthened time required for barrel polishing that is carried out at the time when the border portion 7 is rounded to a curve as described in detail below.

As described above, the curvature radius R preferably ranges from 0.03 mm to 0.05 mm so that the occurrence ratios of defects due to disconnection and differences in the frequency become smaller, and the time required for barrel polishing becomes approximately five hours, which is economically advantageous.

Figure 3A:
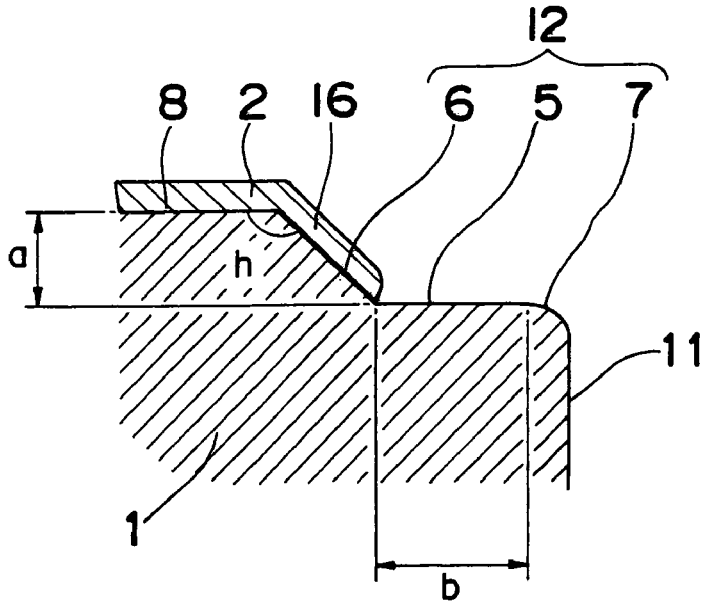
FIG. 3A is an enlarged cross-sectional view showing a portion of the cross-sectional view in the longitudinal direction of FIG. 1.
Figure 3B:
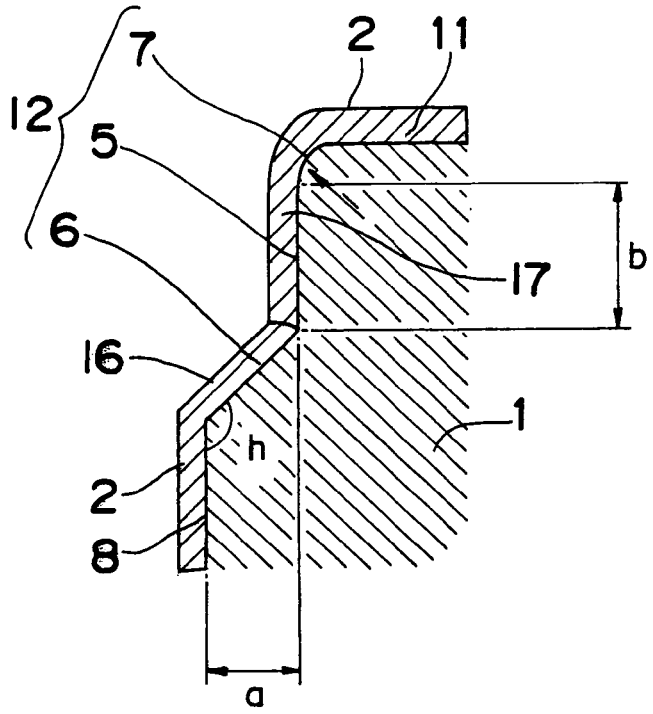
FIG. 3B is an enlarged cross-sectional view showing another portion of the cross-sectional view in the longitudinal direction of FIG. 1.

The conductor is formed on the step 12 by forming the conductor on the surface 11 after forming the conductor on the surface 8 as shown in FIGS. 3A, 3B. Therefore, it is preferable for the depth a of the step 12 that is defined by the distance between the surface that includes the flat portion 5 and the surface 8 that continues to the inclining portion 6, to be 0.15 mm or less. When the depth a of the step 12 is 0.15 mm or less, as shown in FIG. 3A, the sag 16 reaches the flat portion 5 at the time when the conductor 2 is printed on the surface 8 that continues to the inclining portion 6, due to the contact between the screen and the surface along the inclining portion 6, making a sufficient connection possible between the sag 16 and the conductor 2 formed on the flat portion 5, and thus, an electrical disconnection can be effectively prevented.

Furthermore, it is preferable for the angle (inner angle) h formed between the above described inclining portion 6 and the surface 8 to be 100° to 160° because an angle in this range allows the screen to make contact with the surface along the inclining portion 6 at the time when the conductor 2 is printed on the surface 8 in a manner where the sag 16 reaches the flat portion 5, making a sufficient connection with the conductor 2 formed on the flat portion 5, and thus, an electrical disconnection can be effectively prevented. Here, in the case where the above described angle h exceeds 160°, making the inclining portion 6 close to horizontal, the effects of chipping prevention due to step 12 become smaller, increasing defects due to chipping, which relates to an increase in the number of defects due to disconnection. In addition, it is preferable for the angle h of the above described inclining portion 6 to range from 120° to 140°, and an angle in this range allows the sag 16 to occur without failure, making the connection between the conductors more certain.

It is preferable for the difference between the maximum thickness of the conductor 2 formed on the step 12 and the maximum thickness of the conductors 2 formed on the surfaces 8, 11 to be 0.02 mm or less in the small size antenna of Embodiment 1, where the step 12 having a border portion 7 in curved form is formed in the base 1, as described above.

In the case where the difference between these thicknesses is 0.02 mm or less, the gap that occurs between the board 4 and the conductors 2 at the time when the frequency is measured becomes small, even if a portion having a large thickness occurs in the conductors 2 on the step 12, and therefore, no difference exists between the frequency that is measured when the base 1 on which the conductors 2 are formed is secured to the board 4 by means of the solders 3, and the frequency that is measured when the base 1 on which the conductors 2 are formed is secured to the board 4 without utilizing the solders 3, making the frequency measurement with a high precision possible.

Here, the thickness of the above described conductors 2 can be measured by using a surface roughness tester, and the maximum thickness in the conductor 2 formed on the step 12 of the base 1 is denoted as t1, and the maximum thickness in the conductor 2 using the planes as a reference is denoted as t2, after the measurements of the cross-sectional forms of the base 1 and the conductors 2.

Figure 3C:
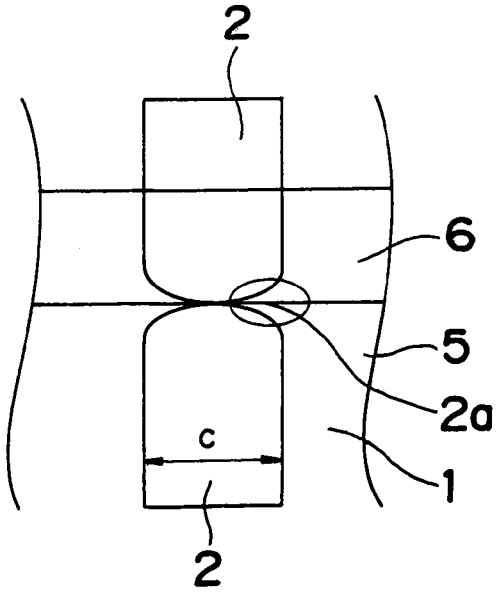
FIG. 3C is a top view showing a step portion.
Figure 4:
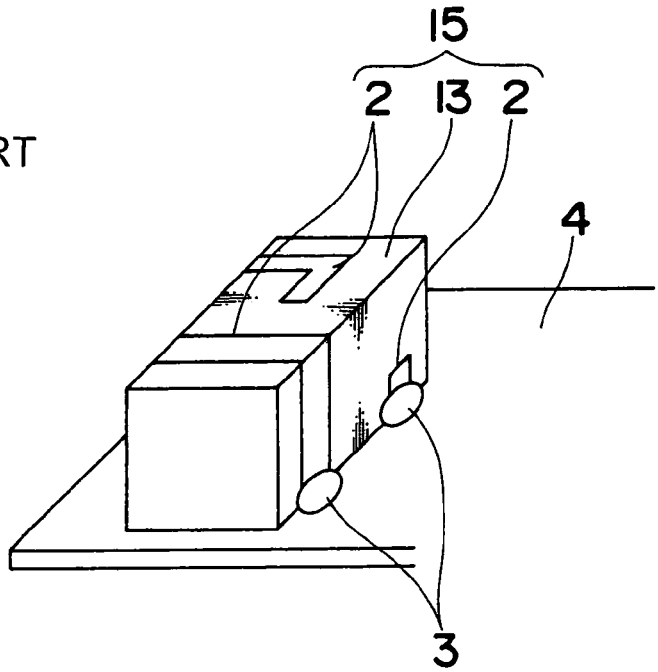
Fig.4 PRIOR ART
FIG. 4 is a perspective view showing a small size antenna according to a prior art.
Figure 5:
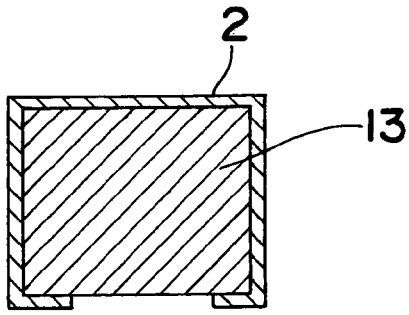
Fig.5 PRIOR ART
FIG. 5 is a cross-sectional view of FIG. 4.
Figure 6:
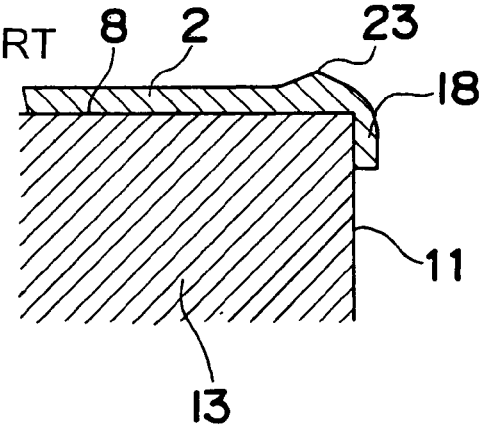
Fig.6 PRIOR ART
FIG. 6 is an enlarged cross-sectional view showing a portion of the cross-sectional view of FIG. 5.
Figure 7:
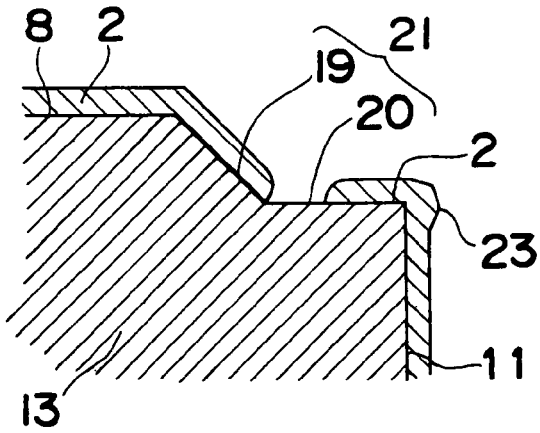
Fig. 7 PRIOR ART
FIG. 7 is an enlarged cross-sectional view showing a portion of a cross-section according to another prior art.
Figure 8A:
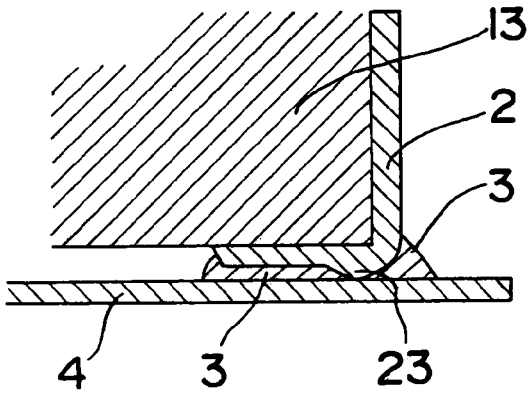
Fig. 8A PRIOR ART
FIG. 8A is an enlarged cross-sectional view showing the connected condition of a small size antenna according to a prior art to a board in the case where soldering is utilized.
Figure 8B:
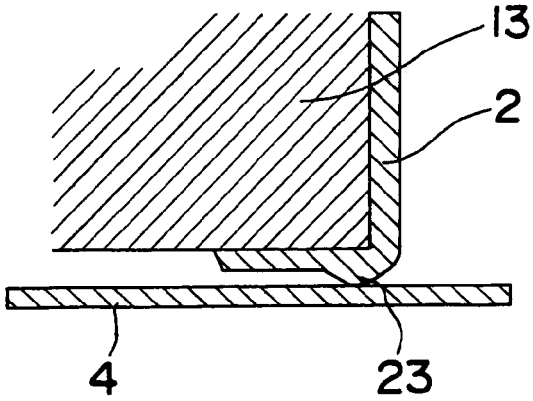
Fig. 8B PRIOR ART
FIG. 8B is an enlarged cross-sectional view showing the connected condition of the small size antenna according to the prior art to a board in the case where soldering is not utilized.

In addition, as shown in FIG. 3C, a missing portion 2*a* of the conductor 2 formed on the above described step 12 can be made 50% or less, relative to the width of conductor 2, thereby reducing the difference in the frequency and preventing the yield from being reduced. That is to say, in the case where the missing portion 2*a* is 50% or less, the frequency change can be suppressed, though the electric resistance and the frequency tend to change when the missing portion 2*a* of the conductors 2 occurs, reducing the width of the conductors 2.

In addition, the width c of the conductor 2 and the dimensions of the missing portion 2*a* of the conductor 2 formed on the step 12 (shown in FIG. 3C) are measured by means of a projector, and the ratio of the missing portion 2*a* is calculated when the width b of the conductor 2 is 100%.

In order to gain the base 1 having the step 12 made of the flat portion 5, the inclining portion 6 and the border portion 7 in curved form as described above, a first dielectric ceramic is formed by means of powder pressing formation using dies, and this is fired so as to fabricate a sintered body. At this time, the upper part and the lower part of the above described dies have forms of the steps 12, and thereby, the steps 12 can be formed in the corner portions of the compact at the time of the press molding. Here, the above described dies cannot shape the form of the border portions 7 into R form, and therefore, the border portions 7 in curved form have not yet been formed in this sintered body. Therefore, barrel polishing is carried out on the original base 1, which is a sintered body, and thereby, the border portions 7 between the flat portions 5 and the planes are made to have curved form. According to this barrel polishing, a certain number of the bases 1, which occupy approximately 30 volume % of the barrel polishing machine, and water, which occupies 50 volume % to 70 volume % of the barrel polishing machine, are placed in the barrel polishing machine, which is rotated for approximately 6 hours, depending on the dimensions and the materials of the bases 1, and thereby, the border portions 7 are formed, and the width b of the flat portions 5 can be made to be 0.08 mm or less.

Here, the small size antenna of the present invention is an antenna of which the volume of the base 1 is approximately 500 $mm^3$ or less, which is mounted on the surface of the board 4 by means of the solder 3 and which can be utilized by being incorporated into a small size communication device such as a cellular phone.

Here, though the step 12 formed in the corner portion between the surfaces 8 and 11 is described in the present Embodiment 1, such steps 12 are formed in all of the corner portions in which the conductors 2 are formed.

In addition, though only the border portions 7 are rounded into curved form by means of barrel polishing in Embodiment 1, borders between the flat portions 5 and the inclining portions 6, as well as borders between the inclining portions 6 and the surfaces 8, may have curved form.

Next, the embodiments of the surface mounting type antenna and the antenna device, as well as the wireless communication device are described in reference to the drawings.

Embodiment 2

Figure 9:
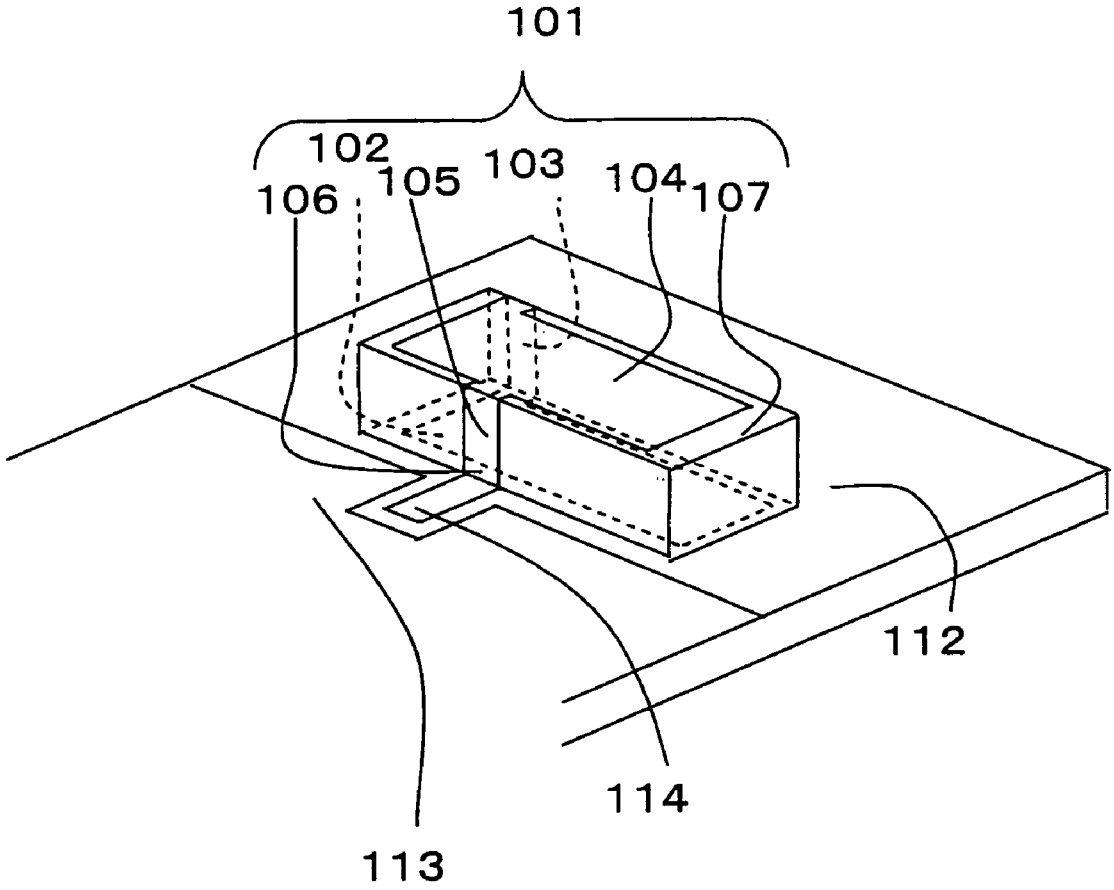
FIG. 9 is a perspective view showing an antenna device according to Embodiment 2 of the present invention.

FIG. 9 is a perspective view of a first antenna device according to Embodiment 2 of the present invention, and the first antenna device of Embodiment 2 is formed of a first surface mounting type antenna 101 and a mounting substrate 112 on which this surface mounting type antenna 101 is mounted.

In addition, the first surface mounting type antenna 101 is formed of a base 107 in rectangular parallelepiped form made of dielectrics or a magnetizer, and of first to fourth radiation electrodes formed on the base 107 as described below.

The first radiation electrode 102 is formed on a first side (the lower surface of the base 107 in FIG. 9) of the base 107.

The second radiation electrode 104 is formed on a second side (the upper surface of the base 107 in FIG. 9) that faces the first side of the base 107.

The third radiation electrode 103 is formed on a third side (the back side of the base 107 in FIG. 9) in the proximity of a first end surface (the back end surface of the base 107 in FIG. 9) so as to connect the first radiation electrode 102 to the second radiation electrode 104.

Here, the third radiation electrode 103 is formed on the third side and on the first side in a continuous manner, and one end thereof formed on the first side is connected to the first radiation electrode 102. In addition, the third radiation electrode 103 is formed on the third side and on the second side in a continuous manner, and the other end thereof formed on the second side is connected to the second radiation electrode 104.

The fourth radiation electrode 105 is formed on a fourth side (the front side of the base 107 in FIG. 9) of the base 107 in a position slightly shifted from the center toward the second end surface (the back end surface of the base 107 in FIG. 9), and one end thereof is connected to the second radiation electrode 104.

Here, the fourth radiation electrode 105 is formed on the fourth side and on the second side in a continuous manner, and one end thereof formed on the second side is connected to the second radiation electrode 104.

Here, the other end of the fourth radiation electrode 105 is connected to a feeding electrode 114, which is formed on the surface of the mounting substrate 112 as a feeding terminal.

In addition, a grounding conductive layer 113 is formed on the mounting surface of the mounting substrate 112 (front left side of the mounting surface of the mounting substrate 112 in FIG. 9).

As described above, the first antenna device of the present Embodiment 2 is formed by mounting the first surface mounting type antenna 101 according to the present invention on the mounting surface in a position away from the grounding conductive layer 113 (back right side of the mounting surface of the mounting substrate 112 in FIG. 9) so that the first radiation electrode 102 faces the mounting surface of the mounting substrate 112, and by connecting the feeding terminal 106 to the feeding electrode 114.

In the first antenna device that is formed as described above, the first surface mounting type antenna 101 of the present invention is an antenna which deals with two frequencies and which has excellent antenna properties, and functions as follows in response to each frequency.

That is to say, a portion formed of the second radiation electrode 104 and the fourth radiation electrode 105 forms a ¼ wavelength monopole antenna that corresponds to the higher frequency f2 of the wireless signals of two frequency bands utilized in the communication system so as to operate as an antenna corresponding to the frequency f2. In addition, the first radiation electrode 102, the third radiation electrode 103, the fourth radiation electrode 105 and a portion of the second radiation electrode 104 form a ¼ wavelength monopole antenna that corresponds to the lower frequency f1 of the wireless signals of the two frequency bands so as to operate as an antenna corresponding to the frequency f1. Accordingly, the first surface mounting type antenna 101 of the present invention and the first antenna device of the present invention that uses this antenna can be made to function as an antenna which deals with two frequencies and which has excellent antenna properties.

Figure 14:
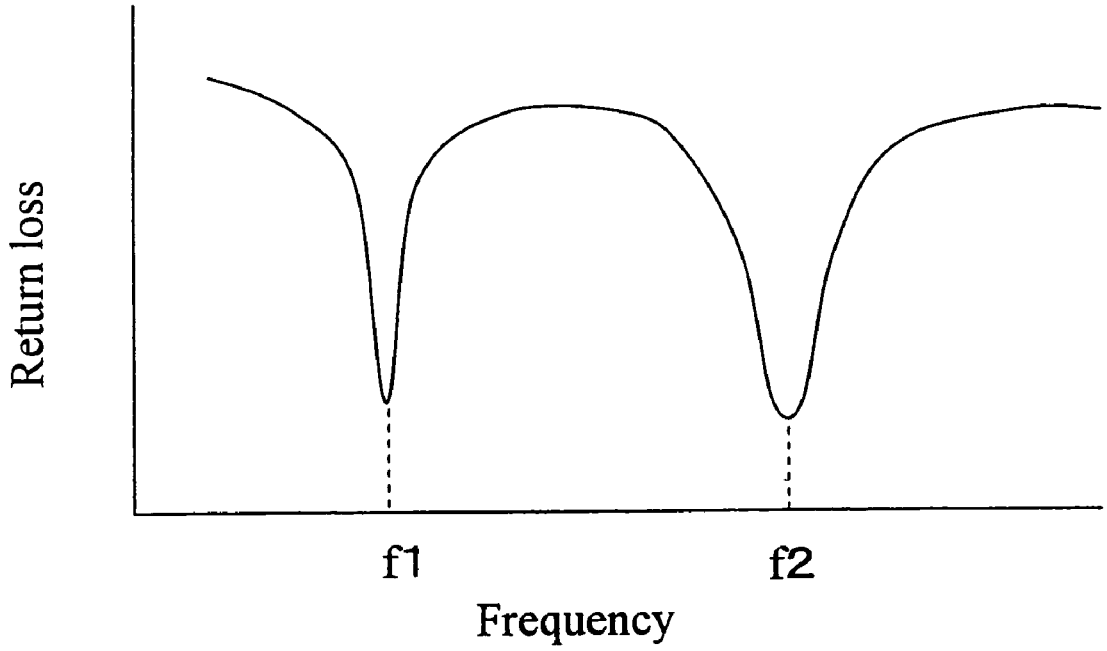
FIG. 14 is a graph showing the frequency properties of a return loss in the antenna device according to Embodiment 2.

FIG. 14 is a graph showing the frequency properties of the return loss of the first antenna device according to the present invention. In the graph of FIG. 14, the lateral axis indicates frequency (of which the unit is GHz), the longitudinal axis indicates return loss (of which the unit is dB), and the property curve indicates the frequency properties of the return loss. As shown in this FIG. 14, the first antenna device of Embodiment 2 operates as an antenna that deals with two different frequencies f1 and f2. Here, such properties are gained in the same manner in the below described second to fourth antenna devices of the present invention.

Figure 13:
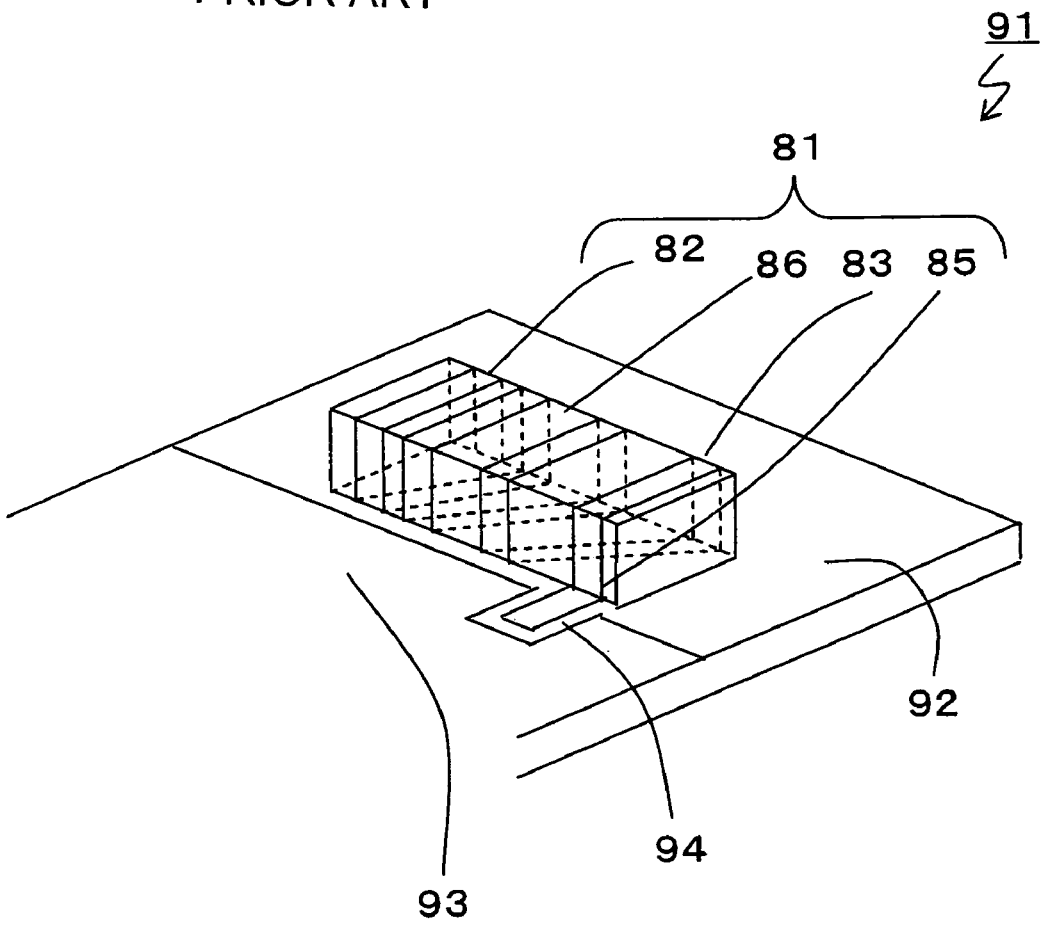
Fig. 13 PRIOR ART
FIG. 13 is a perspective view of an antenna device according to a prior art.
Figure 17A:
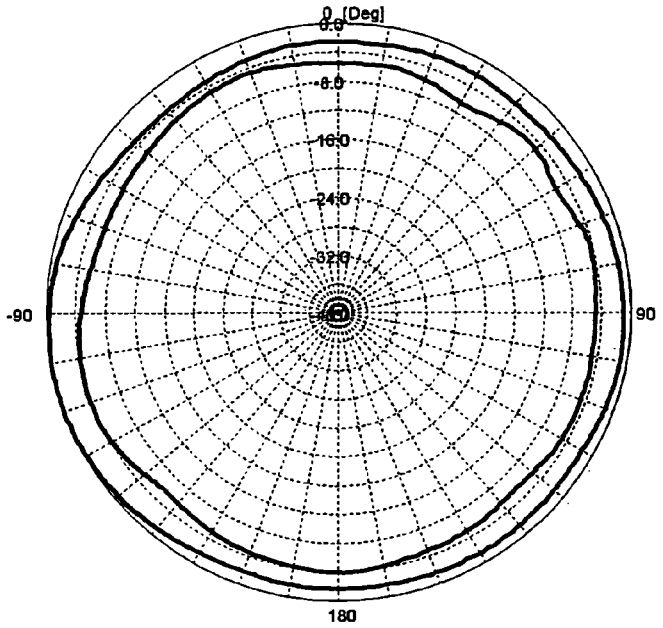
FIG. 17A is a chart showing an example of the radiation properties of the antenna in the antenna device according to Embodiment 2.

In addition, FIG. 17A shows the radiation properties of the first antenna device of the present invention. Here, FIG. 17B shows the radiation properties of an antenna device on which a conventional antenna is mounted as shown in FIG. 13, for the purpose of comparison.

Figure 17B:
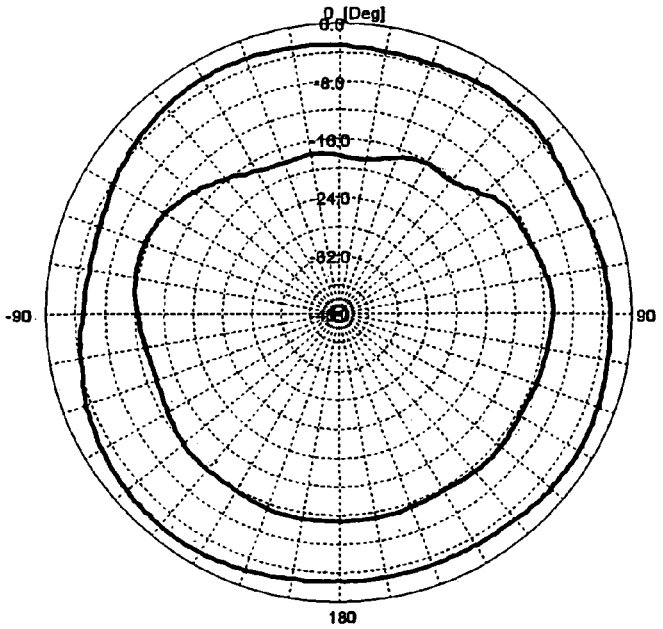
Fig. 17B PRIOR ART
FIG. 17B is a chart showing an example of the radiation properties of an antenna according to a prior art.

FIGS. 17A and 17B indicate that the further the line is away from the center of the graph, the greater is the intensity of the radiation, where the outside radiation properties are the antenna properties on the low frequency side and the inside radiation properties are the antenna properties on the high frequency side. When these antenna properties are compared, it is found that the difference of the properties on the low frequency side (outside) and on the high frequency side (inside) is small in the first antenna device (FIG. 17A) of the present Embodiment 2.

This can be described as follows. That is to say, in the first antenna device of FIG. 9, as described above, the portion on the second radiation electrode 104 side forms an antenna for the high frequency f2, while the first radiation electrode 102 side that is connected via the third radiation electrode 103 forms an antenna for the low frequency f1. The first surface mounting type antenna 101 of the present invention that is formed as described above has a structure where the second radiation electrode 104 that corresponds to the high frequency f2 is installed in a position away from the grounding conductive layer 113 in comparison with the first radiation electrode 102 that corresponds to the low frequency f1, by providing the fourth radiation electrode 105. In addition, the radiation electrodes on the side which corresponds to the high frequency f2 are the second radiation electrode 104 and the fourth radiation electrode 105, which are formed over a plurality of surfaces. As a result of this, radio waves which have a polarized wave perpendicular to the second radiation electrode 104 and which are difficult to be transmitted and received exclusively by the second radiation electrode 104 can be transmitted and received by the fourth radiation electrode 105 so that it becomes possible to transmit and receive the electric wave in every direction.

As described above, the area of the radiation electrode on the high frequency side becomes smaller than the area of the radiation electrode on the low frequency side, and therefore, the first antenna device of the present Embodiment 2 can gain the same radiation properties on the high frequency side as those on the low frequency side, though in general (in a conventional antenna), the radiation properties on the high frequency side become lower than the radiation properties on the low frequency side.

Here, such properties are the same as in the below described second to fourth antenna devices of the present invention.

In the first surface mounting type antenna 101 of the present invention, in the case where the distance between a pair of sides that are opposite to each other (between the first side and the second side) is too small, the coupling due to a current between the first radiation electrode and the second radiation electrode 104, which are respectively formed on these sides, becomes stronger. In the case where the coupling becomes strong, a current flows through the first radiation electrode 102 and the second radiation electrode 104, respectively, in the opposite directions, making it difficult for the antenna to operate. Accordingly, it is desirable for the distance between the opposing first radiation electrode 102 and the second radiation electrode 104 to be as great as possible. In the case of an antenna that deals with 800 MHz and 1900 MHz, for example, it is preferable for the distance between first radiation electrode 102 and second radiation electrode 104 to be 3 mm or more.

In addition, in the first surface mounting type antenna 101 of the present invention, the smaller the widths (sizes in the direction perpendicular to the other pair of sides of base 107) of the first radiation electrode 102 and the second radiation electrode 104, which are respectively formed on a pair of sides that are opposite to each other, the frequency width in each of the transmitted and received frequencies becomes smaller. Furthermore, the shorter the lengths (sizes in the direction perpendicular to the pair of end surfaces of base 107) of the first radiation electrode 102 and the second radiation electrode 104 become, the smaller the frequency widths tend to become. Accordingly, it is preferable for the first radiation electrode 102 and the second radiation electrode 104 to extend in a form as wide as possible toward the ends of base 107.

In addition, in the first antenna device of the present invention, in the case where the distance between the first radiation electrode 102, as well as the second radiation electrode 104 and the grounding conductive layer 113 of the mounting substrate 112, is too small when the first surface mounting type antenna 101 of the present invention is mounted on the mounting substrate 112, the respective frequency widths become smaller. Accordingly, it is necessary to optimize the widths and lengths of the first radiation electrode 102 and the second radiation electrode 104, as well as the distance between these electrodes and the grounding conductive layer 113.

Furthermore, in the first antenna device of the present invention, it is possible to adjust the frequencies by changing the distance between the position of the connection of the fourth radiation electrode 105 to the feeding terminal 106 that is formed of an end portion of the fourth radiation electrode and the end surface of the base 107 of the pair of end surfaces that is closer to the position of the connection, and by changing the length between the fourth radiation electrode 105, including the feeding terminal 106 that is formed in one end portion thereof, and the open end of the second radiation electrode 104, as well is as the length between the fourth radiation electrode 105, including the feeding terminal 106 that is formed in one end portion thereof, and the open end of the first radiation electrode 102.

In the case where the fourth radiation electrode 105 and the feeding terminal 106 that is formed in the end portion of this electrode are shifted toward the open end of the second radiation electrode 104, for example, the distance between the feeding terminal 106 and the open end of the second radiation electrode 104 becomes shorter, and thereby, the frequency f2 becomes higher, while the distance between the feeding terminal 106 and the open end of the first radiation electrode 102 becomes longer, and thereby, the frequency f1 becomes lower. Furthermore, it is possible to adjust the frequencies by connecting a reactance element, for example, a chip inductor, to the feeding electrode 114 in series.

In the case where an antenna is designed as (1) and (2) described in the following, for example, an antenna that deals with two frequencies can be gained, wherein the portion of the first radiation electrode 102 deals with CDMA (of which the frequency band is 824 MHz to 894 MHz) and the portion of the second radiation electrode 104 deals with PCS (of which the frequency band is 1820 MHz to 1990 MHz).

(1) A base 107 where the relative dielectric constant is 9.6, the length is 35 mm, the distance between a pair of sides that face each other is 6 mm, and the distance between the other pair of sides that face each other is 4 mm, is used.

The radiation electrodes are the first radiation electrode 102 where the length is 33 mm and the width is 3.5 mm, the second radiation electrode 104 where the length is 30 mm and the width is 3.5 mm, the third radiation electrode 103 having a width of 4 mm, which is provided in a position at a distance of 0.5 mm away from one end surface of the pair of end surfaces that face each other, the fourth radiation electrode 105 provided in a position at a distance of 15 mm away from one end surface of the pair of end surfaces that face each other, and the feeding terminal 106 formed in an end portion of the fourth radiation electrode.

(2) The first surface mounting type antenna 101 of the present invention that is designed as described above is mounted on the surface of the mounting substrate 112 so that the first radiation electrode 102 side becomes the front side, and the grounding conductive layer 113 having the dimensions of 40 mm×80 mm and the base 107 are separated from each other by a distance of 5 mm.

Embodiment 3

Figure 10:
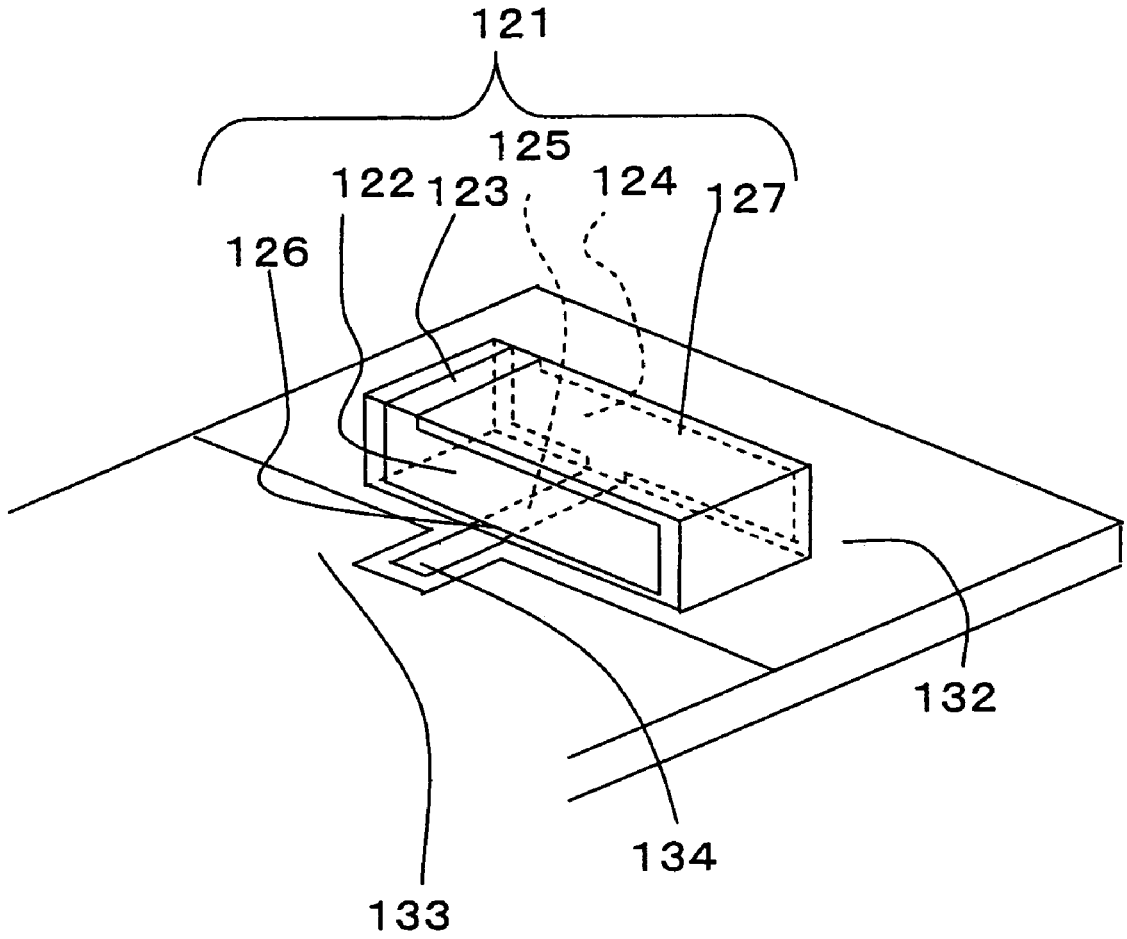
FIG. 10 is a perspective view showing an antenna device according to Embodiment 3 of the present invention.

FIG. 10 is a perspective view of a second antenna device according to Embodiment 3 of the present invention, and the second antenna device of this Embodiment 3 is formed of a second surface mounting type antenna 121 and a mounting substrate 132 on which the antenna 121 is mounted.

The second surface mounting type antenna 121 according to the present Embodiment 3 is formed of a base 127 in rectangular parallelepiped form made of dielectrics or a magnetizer, and of first to fourth radiation electrodes which are formed on the base 127 in the below described manner.

Here, in Embodiment 3, first to fourth sides of the second surface mounting type antenna 121 are defined as follows. That is to say, the side that faces the mounting substrate 132 is referred to as the fourth side, the side that faces the fourth side is referred to as the third side, the side that is closer to the grounding conductive layer 133 of the two sides between the fourth side and the third side is referred to as the first side, and the side that faces the first side is referred to as the second side.

The first radiation electrode 122 is formed on the first side of the base 127 in the second surface mounting type antenna 121 of Embodiment 3.

The second radiation electrode 124 is formed on the second side of the base 127.

The third radiation electrode 123 is formed in the proximity of the first end surface (the back end surface of the base 27 in FIG. 10) on the third side of the base 127, and connects the first radiation electrode 122 to the second radiation electrode 124.

Here, the third radiation electrode 123 is formed on the third side and on the first side in a sequential manner, and one end thereof that is formed on the first side is connected to the first radiation electrode 122. In addition, the third radiation electrode 123 is formed on the third side and on the second side in a sequential manner, and the other end thereof formed on the second side is connected to the second radiation electrode 124.

The fourth radiation electrode 125 is formed on the fourth side of the base 127, and one end thereof is connected to the second radiation electrode 124.

Here, the fourth radiation electrode 125 is formed on the fourth side and on the second side in a continuous manner, and one end thereof formed on the second side is connected to the second radiation electrode 124.

Here, the other end of the fourth radiation electrode 125 is connected to the feeding electrode 134 that is formed on the surface of the mounting substrate 132 as a feeding terminal.

In addition, the grounding conductive layer 133 is formed on the mounting surface (front left side of the mounting surface of the mounting substrate 132 in FIG. 10) of the mounting substrate 132.

Thus, the second antenna device of the present Embodiment 3 is formed by mounting the second surface mounting type antenna 121 that is formed on the mounting substrate 132 as described above, in a manner such that the first side faces the mounting surface of the mounting substrate 132 so that the feeding terminal, which is one end of the fourth radiation electrode, is connected to the feeding electrode 134 on the mounting substrate 132.

The portion formed of the second radiation electrode 124 and the fourth radiation electrode 125 forms a ¼ wavelength monopole antenna that deals with the frequency f2, which is the higher of the wireless signals in the two frequency bands utilized in the communication system, in the second surface mounting type antenna 121 of the present invention that is formed as described above, which can operate as an antenna that deals with the frequency f2.

In addition, the portion formed of the first radiation electrode 122, the third radiation electrode 123, the fourth radiation electrode 125 and a portion of the second radiation electrode 124, forms a ¼ wavelength monopole antenna that deals with the frequency f1, which is the lower of the wireless signals in the two frequency bands, so as to operate as an antenna that deals with the frequency f1. Accordingly, the second surface mounting antenna 121 of the present invention and the second antenna device of the present invention that uses this antenna can function as an antenna which deals with two frequencies and which has excellent antenna properties.

In the second antenna of the present invention that is formed as described above, the second radiation electrode 124 that deals with the high frequency f2 is positioned further away from the grounding conductive layer 133 in comparison with the first radiation electrode 122 side that deals with the low frequency f1, in the second surface mounting type antenna 121. In addition, the second radiation electrode 124 that deals with the high frequency f2 and the fourth radiation electrode 125 are formed over a plurality of surfaces, and thereby, radio waves having a polarized wave perpendicular to the second radiation electrode 124 that is difficult to be transmitted and received exclusively by the second radiation electrode 124 can be transmitted and received by the fourth radiation electrode 125.

Accordingly, the second antenna device and the second surface mounting type antenna 121 of embodiment 3 have the same working effects as the first antenna device and the first surface mounting type antenna 1 of Embodiment 2.

Embodiment 4

Figure 11:
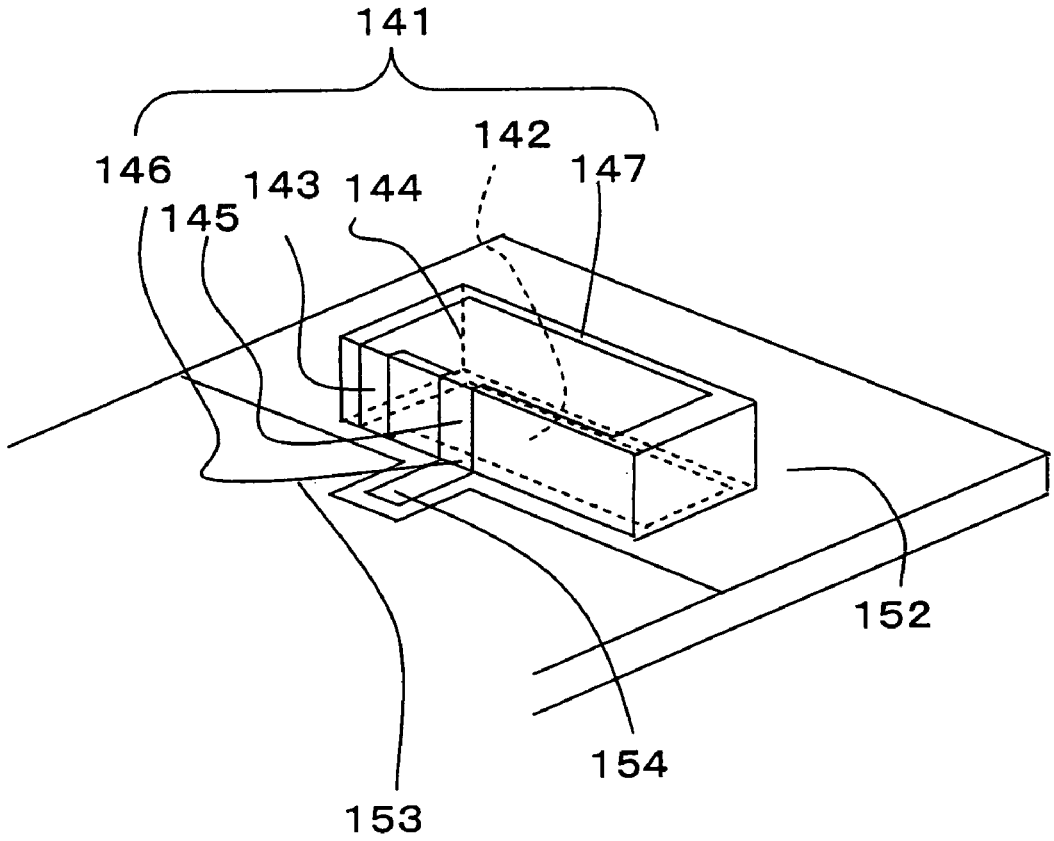
FIG. 11 is a perspective view showing an antenna device according to Embodiment 4 of the present invention.

FIG. 11 is a perspective view showing the configuration of a third antenna device according to Embodiment 4 of the present invention, and the present Embodiment 3 includes a surface mounting type antenna according to the present invention.

A third surface mounting type antenna 141 according to the present Embodiment 4 is formed of a base 147 in rectangular parallelepiped form made of dielectrics or a magnetizer, and of first to fourth radiation electrodes which are formed on the base 147 as described below.

Here, first to fourth sides of the second surface mounting type antenna 141 are defined follows in Embodiment 4. That is to say, the side that faces the mounting substrate 152 is referred to as the first side, the side that faces the first side is referred to as the second side, the side that is closer to the grounding conductive layer 153 of the two sides between the first side and the second side is referred to as the fourth side, and the side that faces the fourth side is referred to as the third side.

A first radiation electrode 142 is formed on the first side of the base 147.

A second radiation electrode 144 is formed on the second side of the base 147.

A third radiation electrode 143 is formed on the fourth side of the base 147 in the proximity of one end surface so as to connect the first radiation electrode 142 to the second radiation electrode 144.

Here, the third radiation electrode 143 is formed on the fourth side and on the first side in a continuous manner, and one end thereof formed on the first side is connected to the first radiation electrode 142. In addition, the third radiation electrode 143 is formed on the fourth side and on the second side in a continuous manner, and the other end thereof formed on the second side is connected to the second radiation electrode 144.

A fourth radiation electrode 145 is formed on the fourth side of the base 147 in a position shifted from the third radiation electrode 143 toward the center, and one end thereof is connected to the second radiation electrode 144 that is formed on the second side.

Here, the fourth radiation electrode 145 is formed on the fourth side and on the second side in a continuous manner, and one end thereof formed on the second side is connected to the second radiation electrode 144.

Here, the other end of the fourth radiation electrode 145 is connected to a feeding electrode 154 that is formed on the surface of the mounting substrate 152 as a feeding terminal.

In addition, a grounding conductive layer 153 is formed on the mounting surface (front left side of the mounting surface of the mounting substrate 152 in FIG. 11) of the mounting substrate 152.

Thus, the third antenna device of the present Embodiment 4 is formed by mounting the third surface mounting type antenna 141 that has been formed as described above on the mounting substrate 152, in a manner such that the first side faces the mounting surface of the mounting substrate 152, so that the feeding terminal, which is one end of the fourth radiation electrode, is connected to the feeding electrode 154 on the mounting substrate 152.

The portion formed of the second radiation electrode 144 and the fourth radiation electrode 145 forms a ¼ wavelength monopole antenna that deals with the frequency f2, which is the higher of the wireless signals in the two frequency bands that are utilized in the communication system, in the third surface mounting type antenna 141 of the present Embodiment 3, which operates as an antenna that deals with the frequency f2.

Furthermore, the first radiation electrode 142, the third radiation electrode 143, the second radiation electrode 144 and a portion of the fourth radiation electrode 145 form a ¼ wavelength monopole antenna that deals with the frequency f1, which is the lower of the wireless signals in the two frequency bands, and the antenna operates so as to deal with the frequency f1. Accordingly, the third surface mounting type antenna 141 of the present invention and the third antenna device of the present Embodiment 4 that uses this antenna can function as an antenna which deals with two frequencies and which has excellent antenna properties.

That is to say, in the third antenna device of the present Embodiment 4, the second radiation electrode 144 that deals with the high frequency f2 is positioned further away from the grounding conductive layer 153 in comparison with the first radiation electrode 142 that deals with the low frequency f1 in the third surface mounting type antenna 141. In addition, the second radiation electrode 144 that deals with the high frequency f2 and the fourth radiation electrode 145 are formed over a plurality of surfaces, and thereby, radio waves having a polarized wave perpendicular to the second radiation electrode 144, which are difficult to be transmitted and received exclusively by the second radiation electrode 144, can be transmitted and received by the fourth radiation electrode 145.

Accordingly, the third antenna device and the third surface mounting type antenna 141 of Embodiment 4 have the same working effects as the first antenna device and the first surface mounting type antenna 101 of Embodiment 2.

Embodiment 5

Figure 12:
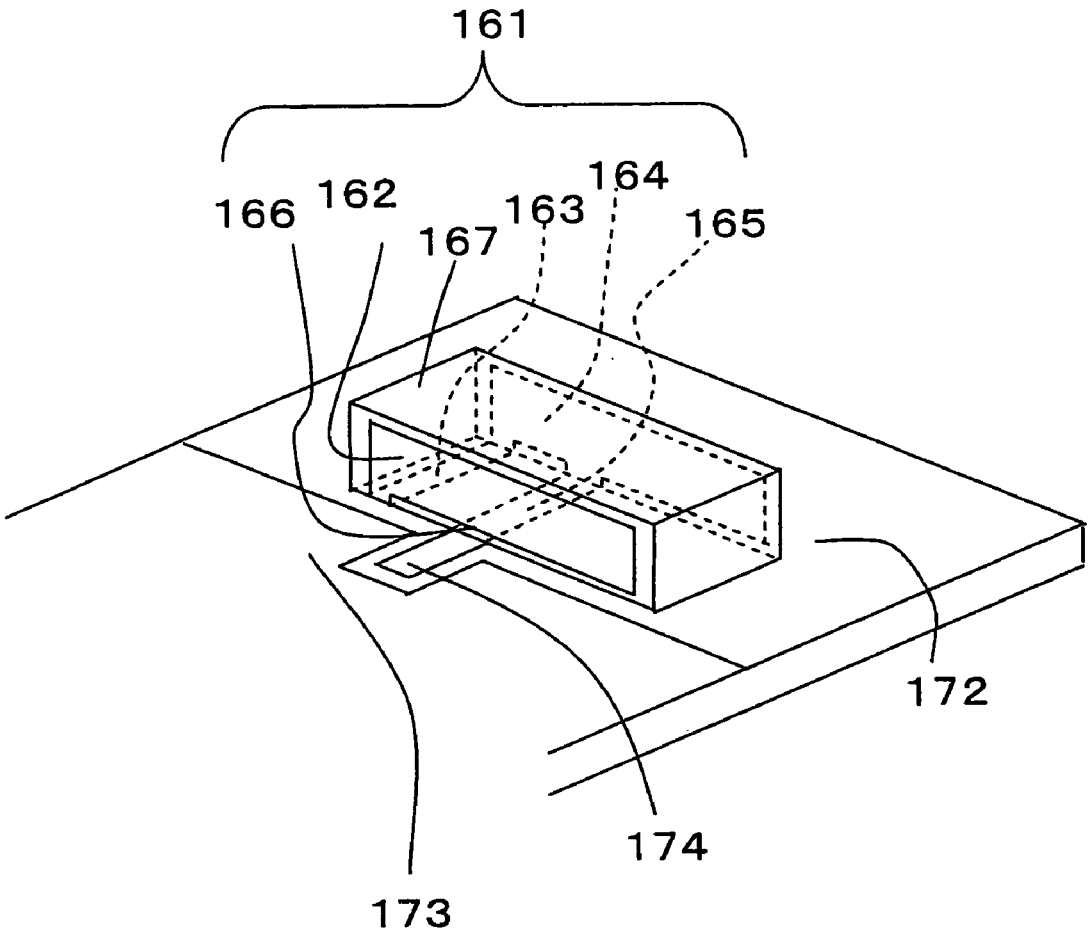
FIG. 12 is a perspective view showing an antenna device according to Embodiment 5 of the present invention.

FIG. 12 is a perspective view showing the configuration of a fourth antenna device according to Embodiment 5 of the present invention, and the present Embodiment 4 includes a fourth surface mounting type antenna according to the present invention.

A fourth surface mounting type antenna 161 of the present Embodiment 5 is formed of a base 167 in rectangular parallelepiped form made of dielectrics or a magnetizer, and of first to fourth radiation electrodes which are formed on the base 167 as described below.

Here, first to fourth sides are defined in the same manner as in Embodiment 3.

A first radiation electrode 162 is formed on the first side of the base 167.

A second radiation electrode 164 is formed on the second side of the base 167.

A third radiation electrode 163 is formed on the fourth side of the base 167 in the proximity of one end surface so as to connect the first radiation electrode 162 to the second radiation electrode 164.

Here, the third radiation electrode 163 is formed on the fourth side and on the first side in a continuous manner, and one end thereof formed on the first side is connected to the first radiation electrode 162. In addition, the third radiation electrode 163 is formed on the fourth side and on the second side in a continuous manner, and the other end thereof formed on the second side is connected to the second radiation electrode 164.

The fourth radiation electrode 165 is formed on the fourth side of the base 167 in a position shifted from the third radiation electrode 163 toward the center, and one end thereof is connected to the second radiation electrode 164 formed on the second side.

Here, the fourth radiation electrode 105 is formed on the fourth side and on the second side in a continuous manner, and one end thereof formed on the second side is connected to the second radiation electrode 104.

Here, the other end of the fourth radiation electrode 165 is connected to the feeding electrode 174 that is formed on the surface of the mounting substrate 172 as a feeding terminal.

In addition, a grounding conductive layer 173 is formed on the mounting surface (front left side of the mounting surface of the mounting substrate 172 in FIG. 12) of the mounting substrate 172.

Thus, the fourth antenna device of the present Embodiment 5 is formed by mounting the third surface mounting type antenna 161 that has been formed in described above on the mounting substrate 172, in a manner such that the first side faces the mounting surface of the mounting substrate 172, so that the feeding terminal which is one end of the fourth radiation electrode is connected to the feeding electrode 174 on the mounting substrate 172.

In the fourth surface mounting type antenna 161 of the present Embodiment 5, the portion formed of the second radiation electrode 162 and the fourth radiation electrode 165 forms a ¼ wavelength monopole antenna that deals with the frequency f2, which is the higher of the wireless signals in the two frequency bands that are utilized in the communication system, and the antenna operates so as to deal with the frequency f2.

Furthermore, the first radiation electrode 162, the third radiation electrode 163, the second radiation electrode 164 and a portion of the fourth radiation electrode 165, form a ¼ wavelength monopole antenna which deals with the frequency f1, which is the lower of the wireless signals in the two frequency bands, and which also operates as an antenna that deals with the frequency f1. Accordingly, the fourth surface mounting type antenna 161 of the present invention and the fourth antenna device of the present Embodiment 5 that uses this antenna can function as an antenna which deals with two frequencies and which has excellent antenna properties.

That is to say, in the fourth antenna device of the present Embodiment 5, the second radiation electrode 164 that deals with the high frequency f2 is positioned further away from grounding conductive layer 173 in comparison with the first radiation electrode 162 that deals with the low frequency f1 in the fourth surface mounting type antenna 161. In addition, the second radiation electrode 164 that deals with the high frequency f2 and the fourth radiation electrode 165 are formed over a plurality of surfaces, and thereby, radio waves having a polarized wave perpendicular to the second radiation electrode 164, which are difficult to be transmitted and received exclusively by the second radiation electrode 164, can be transmitted and received by the fourth radiation electrode 165.

Accordingly, the fourth antenna device and the fourth surface mounting type antenna 161 of Embodiment 5 have the same working effects as the first antenna device and the first surface mounting type antenna 101 of Embodiment 2.

In the first surface mounting type antenna of Embodiments 2 to 5 which has been formed as described above, the third radiation electrode and the fourth radiation electrode are formed on two sides of the base in a continuous manner. Accordingly, it is preferable for the corner portion thereof to have a step portion as described in Embodiment 1.

That is to say, a step having: a flat portion that is parallel to one of the two sides that form the corner portion, in which the third radiation electrode and the fourth radiation electrodes are formed; and an inclining portion located between this flat portion and the side to which the flat portion is parallel, is formed in the corner portion, wherein it is preferable for the width of the flat portion to be 0.08 mm, and for the border portion between the flat portion and the side that continues to this flat portion to be a curve having a curvature radius R of 0.03 mm to 0.2 mm. A step is formed as described above, and thereby, the occurrence of a protrusion of a conductor can be prevented at the time when the conductor is formed, thus making it possible to evaluate the properties without soldering.

In addition, the width of the flat portion is restricted to 0.08 mm or less, and the border portion is a curve having a curvature radius R of 0.03 mm to 0.2 mm, and thereby, it becomes possible to connect conductors formed on the adjacent surfaces to each other without failure at the time when the conductors are formed, and the ratio of defects due to chipping, the ratio of defects due to disconnection, and a variation in the frequency can all be reduced.

Thus, a smaller size surface mounting type antenna can be fabricated easily at low cost.

In the following, the respective elements in the above described Embodiments 2 to 5 are described in detail.

The bases 107, 127, 147 and 167 in the first to fourth surface mounting type antennas 101, 121, 141 and 161 according to the above described present invention are of rectangular parallelepiped form made of dielectrics or a magnetizer, and are made of, for example, a ceramic gained by compressing, forming and then firing powder made of a dielectric material (of which the relative dielectric constant $\epsilon r$ is 9.66) of which the main component is aluminum. In addition, a complex material of a ceramic which is a dielectric body, and a resin may be used, or a magnetizer such as ferrite may be used for the bases 107, 127, 147 and 167.

In the case where the bases 107, 127, 147 and 167 are manufactured of dielectrics, the propagation speed of a high frequency signal that propagates through the first radiation electrodes 102, 122, 142 and 162, the second radiation electrodes 104, 124, 144 and 164, the third radiation electrodes 103, 123, 143 and 163, as well as the fourth radiation electrodes 105, 125, 145 and 165, becomes low, causing the wavelengths to be shortened when the relative dielectric constant of the bases 107, 127, 147 and 167 is denoted as $\epsilon r$, the effective length of the conductor patterns of the first radiation electrodes 102, 122, 142 and 162, the second radiation electrodes 104, 124, 144 and 164, the third radiation electrodes 103, 123, 143 and 163, and the fourth radiation electrodes 105, 125, 145 and 165, becomes $\epsilon r^{1/2}$ times as long, increasing the effective lengths. Accordingly, in the case where the pattern length of the conductor pattern is the same, the region for current distribution is increased, increasing the amount of the radiated waves, and the gain of the antenna can be increased.

Contrarily, in the case of the same properties as conventional properties, the pattern length of the first radiation electrode 102, 122, 142 and 162, the second radiation electrodes 104, 124, 144 and 164, the third radiation electrodes 103, 123, 143 and 163, and the fourth radiation electrodes 105, 125, 145 and 165, can be made $1/(\epsilon r^{1/2})$ times as long, so that miniaturization of the surface mounting type antennas 101, 121, 141 and 161 can be achieved.

Here, in the case where the bases 107, 127, 147 and 167 are fabricated of dielectrics, it tends to be difficult to meet the demand in the market that the antenna should be miniaturized when $\epsilon r$ is smaller than 3 so as to be close to the relative dielectric constant ($\epsilon r=1$) of the air. In addition, in the case where $\epsilon r$ exceeds 30, though the miniaturization is possible, the gain and the bandwidth of the antenna become too small, and the antenna tends not to have the properties of the antenna because the gain and the bandwidth of an antenna are proportional to the size of the antenna. Accordingly, in the case where bases 107, 127, 147 and 167 are fabricated of dielectrics, it is desirable to use a dielectric material of which the relative dielectric constant $\epsilon r$ is no less than 3 and no greater than 30. Such dielectric materials include, for example, ceramic materials such as alumina ceramics, zirconia ceramics, resin materials such as tetrafluoroethylene, glass epoxy and the like.

On the other hand, in the case where the bases 107, 127, 147 and 167 are fabricated of a magnetizer, the first radiation electrodes 102, 122, 142 and 162, the second radiation electrodes 104, 124, 144 and 164, the third radiation electrodes 103, 123, 143 and 163, and the fourth radiation electrodes 105, 125, 145 and 165, have a great impedance, and therefore, Q of the antenna is lowered so that the bandwidth can be expanded.

In the case where the bases 107, 127, 147 and 167 are fabricated of a magnetizer when the relative permeability $\mu r$ exceeds 8, though the bandwidth of the antenna becomes greater, the gain and the bandwidth of the antenna becomes too small because the gain and the bandwidth of the antenna are proportional to the sides of the antenna, and therefore, the antenna tends not to have the properties of the antenna. Accordingly, in the case where the bases 107, 127, 147 and 167 are fabricated of a magnetizer, it is desirable to use a magnetic material of which the relative permeability $\mu r$ is no less than 1 and no greater than 8. Such magnetic materials include, for example, YIG (yttria iron garnet), an Ni—Zr based compound, an Ni—Co—Fe based compound and the like.

The first radiation electrodes 102, 122, 142 and 162, the second radiation electrodes 104, 124, 144 and 164, the third radiation electrodes 103, 123, 143 and 163, the fourth radiation electrodes 105, 125, 145 and 165, and the feeding terminals 106, 126, 146 and 166 are formed of a metal of which the main component is any of, for example, aluminum, copper, nickel, silver, palladium, platinum and gold. In order to form the respective patterns of any of such metals, a thin film formation method such as a variety of printing methods, a vapor deposition method or a spattering method; a method for adhering a metal foil; or a plating method may be used, and thereby, a conductive layer in respectively desired pattern forms may be formed on a predetermined side of the bases 107, 127, 147 and 167.

A conventional circuit substrate such as glass epoxy or alumina ceramics may be used for the mounting substrates 112, 132, 152 and 172.

In addition, the grounding conductive layers 113, 133, 153 and 173, and feeding electrodes 114, 134, 154 and 174, may be formed of a conductor such as copper or silver that is utilized for a conventional circuit substrate.

Here, solder mounting by means of a reflow furnace or the like can be utilized according to a method for connecting the feeding terminals 106, 126, 146 and 166 to the feeding electrodes 114, 134, 154 and 174 when the first to fourth surface mounting type antennas 101, 121, 141 and 161 are mounted on the surface of the mounting substrates 112, 132, 152 and 172.

Figure 15:
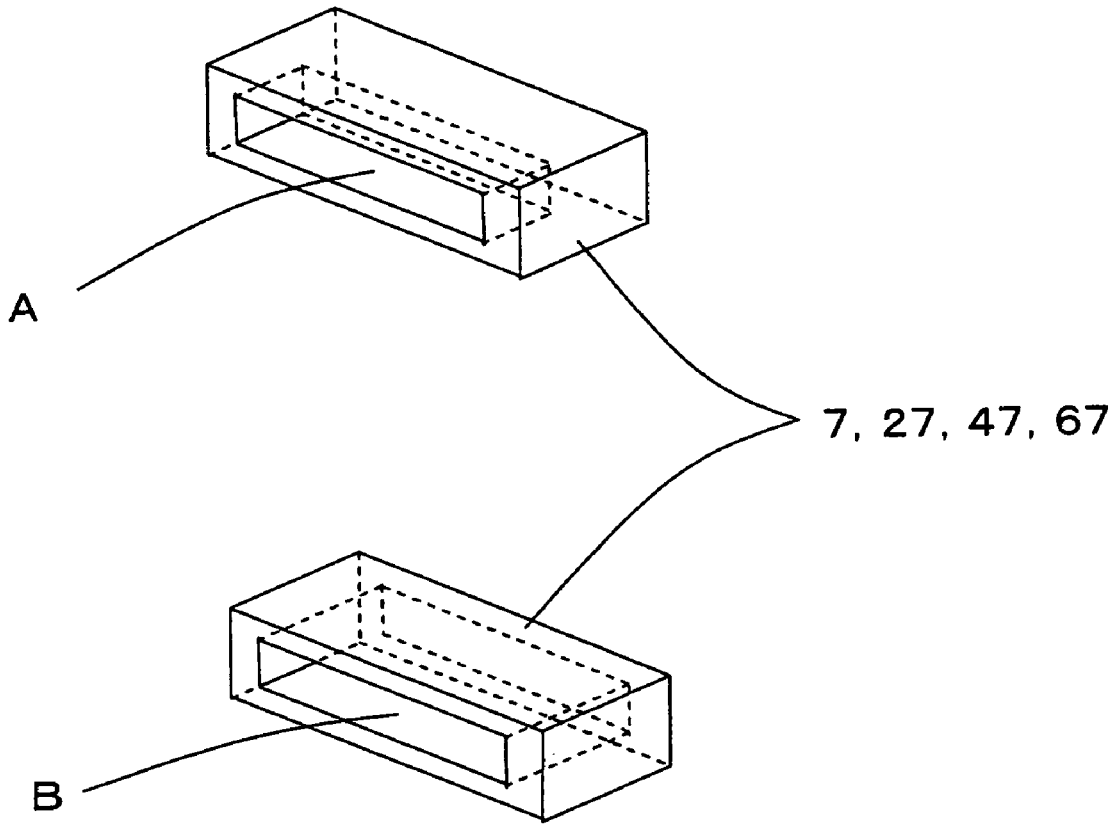
FIG. 15 is a perspective view showing an example of the base that is utilized for a surface mounting type antenna according to a modification of the present invention.

Here, a recess A or a through hole B may be provided in the first to fourth surface mounting type antennas 101, 121, 141 and 161 of the present invention, in the direction from one side to the other side or from the other side to one side of the other pair of sides that face each other of the bases 107, 127, 147 and 167 as shown in the bases 107, 127, 147 and 167 in the perspective view of FIG. 15, and thereby, the antenna can be reduced in weight and the reliability in the mounting strength against an impulse after the mounting can be increased.

In addition, the wireless communication device (not shown) of the present invention is provided with any of the above described first to fourth surface mounting type antennas 101, 121, 141 and 161 of the present invention, or any of the first to fourth antenna devices of the present invention, and at least either a transmission circuit or a reception circuit which are connected to the antenna or the antenna device, and which deal with wireless signals in two different frequency bands. In addition, a wireless signal processing circuit may be connected to the surface mounting type antenna, the antenna device, the transmission circuit or the reception circuit, in order to make wireless communication possible, if desired, or a variety of configurations in addition to this can be adopted.

Such a wireless communication device of the present invention is provided with any of the first to fourth surface mounting type antennas 101, 121, 141 and 161 as described above, or any of the first to fourth antenna devices of the present invention, and at least either the transmission circuit or the reception circuit, which is connected to the antenna or the antenna device, and which deals with wireless signals in two different frequency bands, and therefore, becomes a small size, highly functional wireless communication device that deals with two frequencies where one surface mounting type antenna or antenna device deals with two different frequencies.

Figure 16:
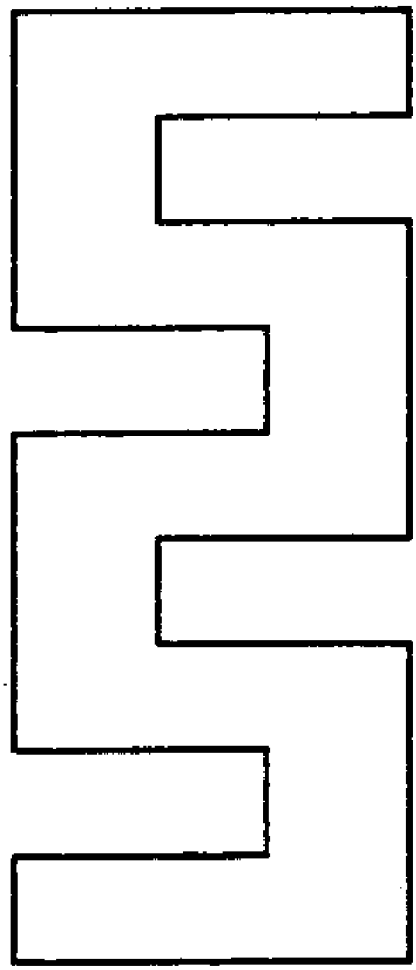
FIG. 16 is a plan view showing an example of the form of a radiation electrode that is utilized for a surface mounting type antenna according to a modification of the present invention.

Here, the surface mounting type antenna and the antenna device of the present invention are not limited to the examples of the above described embodiments, but rather, a variety of modifications may be made, as long as the gist of the present invention is not deviated from. For example, the forms of the first radiation electrodes 102, 122, 142 and 162, the second radiation electrodes 104, 124, 144 and 164, the third radiation electrodes 103, 123, 143 and 163, and the fourth radiation electrodes 105, 125, 145 and 165 of the first to fourth surface mounting type antennas 101, 121, 141 and 161 are not limited to those in rectangular form respectively shown in FIGS. 9 to 12, but rather, may be radiation electrodes in meander form as shown in the plan view of FIG. 16, wherein an antenna that deals with a lower frequency or a smaller size antenna can be made by changing the electrical length in this manner.

EXAMPLES

In the following, examples that relate to Embodiment 1 according to the present invention are described.

A small size antenna 14 as shown in FIG. 1 is fabricated in the present example.

First, a base 1 in rectangular parallelepiped form where the outer side length x is 10 mm, the outer side length y is 4 mm and the thickness is 4 mm, is formed utilizing alumina ceramics (of which the relative dielectric constant is 9 to 10). Here, samples having a variety of dimensions as shown in table 1 are fabricated by changing the width b of the flat portion 5 of the step 12, the depth a of the step, the curvature radius R of the border portion 7, and the angle h of the inclining portion 6 through the alternation of the dimensions of the dies and the period of time required for barrel polishing.

Then, a thick film of Ag is printed on the four sides of these bases 1, respectively, and after that, they are dried in the air at a predetermined temperature, followed by the sintering, and conductors 2 having a thickness of 0.02 mm are formed. Here, the dimensions of the conductors 2 are determined in a manner that the frequency at which the antennas work becomes 1.575 GHz.

The thicknesses and the resonance frequencies of the conductors 2 formed on the surface 9, and on the border portion 7, as well as the width and the dimensions of the missing portions 2*a* of the conductor 2 on the border portion 7 are measured for small size antennas, 14, 1000 of which have been gained for each type.

The thickness of a conductor 2 is measured by utilizing a surface roughness tester for measuring the cross-sectional forms of a base 1 and a conductor 2, and the difference is found between the thickness t1 that is the maximum value of the thickness of the conductor 2 that is formed on the step 12 in the base 1, and the thickness t2 that is the maximum value of the thickness of the conductor 2 formed on the surfaces 9, 11 of the base 1.

In addition, the width b of the conductor 2 and the dimensions of the missing portion 2*a* in the flat portion 5 are measured by means of a projector, and the ratio of the missing portion 2*a* relative to the width b of the conductor 2, which is 100%, is calculated.

Furthermore, the small size antenna 14 is placed on a board 4, to which electrodes for measuring have been provided, without utilizing solders 3, and is connected to a network analyzer through a coaxial cable, and thereby, the frequency is measured. In addition, the existence of a disconnection is confirmed by means of a microscope for the antennas of which the resonance frequency cannot be measured. After that, the antenna is secured to the board 4 by utilizing the solders 3, and the frequency is measured in the same manner so that the maximum value of the difference in the frequency between when solders 3 are utilized and when solders are not utilized is gained as a shift amount of frequency. In addition, the difference between the maximum value and the minimum value of the frequency, which have been measured without using solders 3, is gained as variation in frequency.

Chipping is also confirmed by means of a microscope, and products having a chipping of 0.5 mm or greater are categorized as defects.

Here, the measurement of the thickness of a conductor 2, the ratio of the missing portion 2*a* of a conductor 2 and the measurement of the frequency when utilizing solders 3 are respectively carried out for 20 products.

The results thereof are shown in table 1.

Here, the products marked with an asterisk * are out of the scope of the present invention.

TABLE 1-1

| | Step depth a unit: mm | Size of flat portion b unit: mm | Curvature radius R unit: mm | Angle of inclining surface h unit: ° | Time required for barrel polishing | Difference in thickness mm | Ratio of missing portion of conductor % |
|---|---|---|---|---|---|---|---|
| *1 | 0.00 | 0.00 | R0.00 | 0 | 0 Hr | 0.025 | 13 |
| *2 | 0.20 | 0.11 | R0.00 | 135 | 0 Hr | 0.023 | 73 |
| *3 | 0.15 | 0.11 | R0.00 | 135 | 0 Hr | 0.026 | 69 |
| *4 | 0.10 | 0.11 | R0.00 | 135 | 0 Hr | 0.024 | 56 |
| 5 | 0.20 | 0.08 | R0.03 | 135 | 3 Hr | 0.012 | 68 |
| 6 | 0.15 | 0.08 | R0.03 | 135 | 3 Hr | 0.013 | 13 |
| 7 | 0.15 | 0.06 | R0.05 | 135 | 5 Hr | 0.008 | 14 |
| 8 | 0.10 | 0.08 | R0.03 | 135 | 3 Hr | 0.011 | 21 |
| 9 | 0.10 | 0.06 | R0.05 | 135 | 5 Hr | 0.007 | 16 |
| 10 | 0.10 | 0.04 | R0.20 | 135 | 16 Hr | 0.007 | 21 |
| *11 | 0.10 | 0.02 | R0.22 | 135 | 18 Hr | 0.006 | 13 |
| *12 | 0.10 | 0.10 | R0.01 | 135 | 1 Hr | 0.022 | 19 |
| 13 | 0.10 | 0.06 | R0.05 | 100 | 5 Hr | 0.006 | 18 |
| 14 | 0.10 | 0.06 | R0.05 | 90 | 5 Hr | 0.006 | 23 |
| 15 | 0.10 | 0.06 | R0.05 | 160 | 5 Hr | 0.007 | 16 |
| *16 | 0.10 | 0.06 | R0.05 | 170 | 5 Hr | 0.006 | 17 |

TABLE 1-2

| | Variation in frequency MHz | Shift amount of frequency unit: MHz | Ratio of defects due to chipping | Ratio of defects due to disconnection |
|---|---|---|---|---|
| *1 | 6 | 4.3 | 18.0% | 3.5% |
| *2 | 18 | 3.9 | 0.3% | 35.2% |
| *3 | 18 | 5.1 | 0.4% | 4.7% |
| *4 | 15 | 4.4 | 0.3% | 5.3% |
| 5 | 17 | 0.6 | 0.2% | 4.7% |
| 6 | 6 | 0.4 | 0.2% | 0.2% |
| 7 | 5 | 0.5 | 0.2% | 0.1% |
| 8 | 7 | 0.7 | 0.2% | 0.1% |
| 9 | 6 | 0.4 | 0.2% | 0.1% |
| 10 | 6 | 0.3 | 0.1% | 0.2% |
| *11 | 6 | 0.4 | 0.1% | 0.3% |
| *12 | 5 | 3.8 | 0.3% | 1.9% |
| 13 | 5 | 0.5 | 0.2% | 0.2% |
| 14 | 6 | 0.4 | 0.6% | 3.3% |
| 15 | 5 | 0.5 | 0.3% | 0.2% |
| *16 | 5 | 0.5 | 3.2% | 1.6% |

As seen from Table 1, the samples (Nos. 5 to 10 and 13 to 16) where the width b of the flat portion 5 is 0.08 mm or less and the curvature radius R of the border portion 7 is 0.03–0.2 mm in the step 12 of the base 1 have a difference in the thickness of the conductor of 0.013 mm or less, a ratio of the missing portion of the conductor of 68% or lower, a variation in frequency of 17 MHz or less, a shift amount of the measured value of the frequency of 0.7 MHz or less, a ratio of defects due to chipping of 3.2% or lower, and a ratio of defects due to disconnection of 4.7% or lower.

In particular, the samples (Nos. 6 to 10 and 13 to 15) where the depth a of the step 12 is 0.15 mm or less and the angle h of the inclining portion 6 is 100° to 160° have excellent values, such as a difference in the thickness of the conductor of 0.013 mm or less, a ratio of the missing portion of the conductor of 23% or lower, a variation in the frequency of 7 MHz or less, a shift amount of the measured value of the frequency of 0.7 MHz or less, a ratio of defects due to chipping of 0.2% or lower, and a ratio of defects due to disconnection of 3.3 or lower.

Here, in the case where the curvature radius R of the border portion 7 is greater than 0.2 mm, the time required for barrel polishing becomes 16 hours or longer, which is economically disadvantageous, and therefore, the curvature radius R is set to be 0.03 mm to 0.2 mm.

Contrarily, samples (No. 1) having no steps, samples (Nos. 2 to 4) having steps where the border portions are not in curved form, and samples (Nos. 11 and 12) where the curvature radius of the border portions in the steps is less than 0.3 mm or exceeds 0.2 mm, have a difference in the thickness of the conductor of 0.026 mm, a ratio of the missing portion of the conductor of 73%, a variety in the frequency of 18 MHz or less, a shift amount of the measured value of the frequency of 5.1 MHz or less, a ratio of defects due to chipping of 18% or lower, and a ratio of defects due to disconnection of 35.2% or lower, and it is found from these significantly large values that precise frequencies cannot be measured, due to the disconnections of the conductors in the steps.

A surface mounting type antenna and an antenna device, as well as a wireless communication device according to the present invention can be utilized in a mobile communication device such as a portable terminal, a network wireless device such as a wireless LAN, a car antenna and the like.

What is claimed is:

1. A small size antenna comprising a base in rectangular parallelepiped form made of dielectric ceramics and a conductor formed on at least two adjoining surfaces of said base continuously, characterized in that: a corner portion of said two adjoining surfaces on which said conductor is formed has a step having a flat portion parallel to one surface of said two adjoining surfaces and an inclining portion located between said one surface and said flat portion, the width of said flat portion is 0.08 mm or less; and a border portion between said flat portion and the other surface of said two adjoining surfaces is a curved surface having a curvature radius R of 0.03 mm to 0.2 mm.

2. The small size antenna according to claim 1, characterized in that the depth of said step is 0.15 mm or less.

3. The small size antenna according to claim 1, characterized in that the inner angle between said one surface and said inclining portion is 100° to 160°.

4. The small size antenna according to claim 1, characterized in that the difference between the thickness of the conductor formed on said step and the thickness of the conductor formed on said two adjoining surfaces is 0.02 mm or less.

5. The small size antenna as in one of claims 1 to 4, characterized in that a missing portion of the conductor formed on said step is 50% or less relative to the width of the conductor.

6. A surface mounting type antenna characterized by comprising:

a base in rectangular parallelepiped form made of dielectrics or a magnetizer;

a first radiation electrode formed on one side of two sides that face each other;

a second radiation electrode formed on the other side of said two sides;

a third radiation electrode which is an electrode for connecting said first radiation electrode to said second radiation electrode, and which is formed on said one side, on said other side and on another side different from said two sides, in a sequential manner so as to extend from said one side to said other side through said side different from said two sides; and a fourth radiation electrode which is an electrode of which one end is connected to said second radiation electrode, and of which the other end is used as a feeding terminal, and which is formed on said other side and on said side different from said two sides or on a side that faces said side different from said two sides, in a sequential manner;

wherein the first radiation electrode is connected only to the third radiation electrode.

7. The surface mounting type antenna according to claim 6, wherein said base has a recess in said side different from said two sides or in the side that faces said side different from said two sides.

8. The surface mounting type antenna according to claim 6, wherein said base has a through hole that runs from said side different from said two sides to the side that faces said side different from said two sides.

9. A surface mounting type antenna characterized by comprising:

a base in rectangular parallelepiped form made of dielectrics or a magnetizer;

a first radiation electrode formed on one side of two sides that face each other;

a second radiation electrode formed on the other side of said two sides;

a third radiation electrode which is an electrode for connecting said first radiation electrode to said second radiation electrode, and which is formed on said one side, on said other side and on another side different from said two sides, in a sequential manner so as to extend from said one side to said other side through said side different from said two sides; and a fourth radiation electrode which is an electrode of which one end is connected to said second radiation electrode, and of which the other end is used as a feeding terminal, and which is formed on said other side, and on said side different from said two sides or on a side that faces said side different from said two sides, in a sequential manner;

wherein: a step having an inclining portion and a flat portion parallel to either side is formed in a corner portion on which at least either said third radiation electrode or said fourth radiation electrode is formed; the width of said flat portion is 0.08 mm; and a border portion between said flat portion and a side that continues to this flat portion is a curve having a curvature radius R 0.03 mm to 0.2 mm.

10. An antenna device, characterized by comprising:

(1) a surface mounting type antenna having:

a base in rectangular parallelepiped form made of dielectrics or a magnetizer;

a first radiation electrode formed on one side of two sides that face each other;

a second radiation electrode formed on the other side of said two sides;

a third radiation electrode which is an electrode for connecting said first radiation electrode to said second radiation electrode, and which is formed on said one side, on said other side and on another side different from said two sides, in a sequential manner so as to extend from said one side to said other side through said side different from said two sides; and a fourth radiation electrode which is an electrode of which one end is connected to said second radiation electrode, and of which the other end is used as a feeding terminal, and which is formed on said other side and on said side different from said two sides or on a side that faces said side different from said two sides, in a sequential manner;

wherein the first radiation electrode is connected only to the third radiation electrode; and (2) a mounting substrate having a feeding electrode and a grounding conductive layer that is separate from the feeding electrode on a mounting surface, wherein said surface mounting type antenna is mounted on said mounting surface in a manner that the distance between said second radiation electrode and said grounding conductive layer becomes greater than the distance between said first radiation electrode and said grounding conductive layer, and said feeding terminal is connected to said feeding electrode.

11. The antenna device according to claim 10, wherein said surface mounting type antenna is mounted on said mounting surface in a manner that said two sides are parallel to said mounting surface.

12. The antenna device according to claim 10, wherein said surface mounting type antenna is mounted on said mounting surface in a manner that said two sides are perpendicular to said mounting surface.

13. An antenna device, characterized by comprising:

(1) a surface mounting type antenna having:

a base in rectangular parallelepiped form made of dielectrics or a magnetizer;

a first radiation electrode formed on one side of two sides that face each other;

a second radiation electrode formed on the other side of said two sides;

a third radiation electrode which is an electrode for connecting said first radiation electrode to said second radiation electrode, and which is formed on said one side, on said other side and on another side different from said two sides, in a sequential manner so as to extend from said one side to said other side through said side different from said two sides; and a fourth radiation electrode which is an electrode of which one end is connected to said second radiation electrode, and of which the other end is used as a feeding terminal, and which is formed on said other side, and on said side different from said two sides or on a side that faces said side different from said two sides, in a sequential manner; and (2) a mounting substrate having a feeding electrode and a grounding conductive layer that is separate from the feeding electrode on a mounting surface, wherein said surface mounting type antenna is mounted on said mounting surface in a manner that the distance between said second radiation electrode and said grounding conductive layer becomes greater than the distance between said first radiation electrode and said grounding conductive layer, and said feeding terminal is connected to said feeding electrode;

wherein: a step having an inclining portion and a flat portion parallel to either side is formed in a corner portion on which at least either said third radiation electrode or said fourth radiation electrode is formed; the width of said flat portion is 0.08 mm; and a border portion between said flat portion and a side that continues to this flat portion is a curve having a curvature radius R of 0.03 mm to 0.2 mm.

14. A wireless communication device, characterized by comprising:

(1) a surface mounting type antenna having:

a base in rectangular parallelepiped form made of dielectrics or a magnetizer;

a first radiation electrode formed on one side of two sides that face each other;

a second radiation electrode formed on the other side of said two sides;

a third radiation electrode which is an electrode for connecting said first radiation electrode to said second radiation electrode, and which is formed on said one side, on said other side and on another side different from said two sides, in a sequential manner so as to extend from said one side to said other side through said side different from said two sides; and a fourth radiation electrode which is an electrode of which one end is connected to said second radiation electrode, and of which the other end is used as a feeding terminal, and which is fanned on said other side, and on said side different from said two sides or on a side that faces said side different from said two sides, in a sequential manner;

wherein the first radiation electrode is connected only to the third radiation electrode; and (2) a transmission circuit and/or a reception circuit, which are connected to said feeding terminal.

15. A wireless communication device, characterized by comprising:

(1) a surface mounting type antenna having:

a base in rectangular parallelepiped form made of dielectrics or a magnetizer;

a first radiation electrode formed on one side of two sides that face each other;

a second radiation electrode formed on the other side of said two sides;

a third radiation electrode which is an electrode for connecting said first radiation electrode to said second radiation electrode, and which is formed on said one side, on said other side and on another side different from said two sides, in a sequential manner so as to extend from said one side to said other side through said side different from said two sides; and a fourth radiation electrode which is an electrode of which one end is connected to said second radiation electrode, and of which the other end is used as a feeding terminal, and which is fanned on said other side, and on said side different from said two sides or on a side that faces said side different from said two sides, in a sequential manner; and (2) a transmission circuit and/or a reception circuit, which are connected to said feeding terminal;

wherein: a step having an inclining portion and a fiat portion parallel to either side is formed in a corner portion on which at least either said third radiation electrode or said fourth radiation electrode is formed; the width of said flat portion is 0.08 mm; and a border portion between said flat portion and a side that continues to this flat portion is a curve having a curvature radius R of 0.03 mm to 0.2 mm.

16. The wireless communication device according to claim 14, further comprising a mounting substrate having a feeding electrode and a grounding conductive layer that is separate from the feeding electrode on a mounting surface, wherein said surface mounting type antenna is mounted on said mounting surface in a manner that the distance between said second radiation electrode and said grounding conductive layer becomes greater than the distance between said first radiation electrode and said grounding conductive layer, and said feeding terminal is connected to said feeding electrode.

* * * * *